US009351611B1

(12) United States Patent
Adrian

(10) Patent No.: US 9,351,611 B1
(45) **Date of Patent: *May 31, 2016**

(54) PORTABLE WATER HEATER

(75) Inventor: Trevor Adrian, Park City, UT (US)

(73) Assignee: TAPH, LLC, Park City, UT (US)

( * ) Notice: Subject to any disclaimer, the term of this patent is extended or adjusted under 35 U.S.C. 154(b) by 1163 days.

This patent is subject to a terminal disclaimer.

(21) Appl. No.: 12/980,086

(22) Filed: Dec. 28, 2010

Related U.S. Application Data

(63) Continuation-in-part of application No. 12/409,411, filed on Mar. 23, 2009, now Pat. No. 8,204,618, which is a continuation of application No. 10/802,426, filed on Mar. 17, 2004, now Pat. No. 7,506,386, which is a continuation-in-part of application No. 10/216,496, filed on Aug. 9, 2002, now Pat. No. 6,978,496.

(60) Provisional application No. 61/290,687, filed on Dec. 29, 2009, provisional application No. 60/311,731, filed on Aug. 10, 2001.

(51) Int. Cl.

| | |
|---|---|
| ***A47K 3/28*** | (2006.01) |
| ***F24C 3/14*** | (2006.01) |
| ***F24C 5/20*** | (2006.01) |
| ***F24H 1/06*** | (2006.01) |
| ***F24H 1/08*** | (2006.01) |

(52) U.S. Cl.
CPC ..... *A47K 3/28* (2013.01)

(58) Field of Classification Search
None
See application file for complete search history.

(56) References Cited

U.S. PATENT DOCUMENTS

| | | | | |
|---|---|---|---|---|
| 489,660 | A | 1/1893 | Pellow | |
| 913,832 | A | 3/1909 | Lyon et al. | |
| 969,714 | A | 9/1910 | Meem | |
| 1,023,450 | A | 4/1912 | Wheeler | |
| 1,271,487 | A * | 7/1918 | Reid | 122/250 R |
| 1,618,434 | A * | 2/1927 | Humphrey | 122/250 R |
| 1,957,365 | A * | 5/1934 | Stewart | 126/392.1 |
| 1,991,557 | A * | 2/1935 | Johnson | F24H 1/00 122/14.1 |
| 2,083,837 | A * | 6/1937 | Goecke | 165/74 |
| 2,294,579 | A * | 9/1942 | Sherman | 126/101 |
| 2,373,767 | A * | 4/1945 | McCollum | B64D 13/08 122/250 R |
| 2,541,245 | A * | 2/1951 | Halmasy, Sr. | 122/248 |
| 2,541,254 | A * | 2/1951 | Huck et al. | 101/415.1 |
| 2,567,506 | A * | 9/1951 | Bowman | A47K 3/284 4/598 |
| 3,140,740 | A * | 7/1964 | Lagreid et al. | 126/6 |
| 3,192,916 | A * | 7/1965 | Vitkay | F24H 1/06 126/344 |

(Continued)

FOREIGN PATENT DOCUMENTS

| | | |
|---|---|---|
| EP | 000107960 | 5/1984 |
| JP | 401027521 | 1/1989 |

OTHER PUBLICATIONS

U.S. Appl. No. 60/311,731, filed Aug. 10, 2001, Adrian.

(Continued)

*Primary Examiner* — Gregory Huson
*Assistant Examiner* — Eric Gorman
(74) *Attorney, Agent, or Firm* — Workman Nydegger

(57) ABSTRACT

A portable water heater is described. The portable water heater may include a housing. A base may be mounted to said housing. The base may include a plurality of base members that may be pivotably and/or slidably mounted to the base. At least one thermal source may be disposed within the housing. The thermal source may be configured to produce thermal energy in the housing. A thermal transfer conduit may be disposed within the housing.

20 Claims, 20 Drawing Sheets

(56) References Cited

U.S. PATENT DOCUMENTS

| | | | | | |
|---|---|---|---|---|---|
| 3,359,949 | A | * | 12/1967 | Bjarnason et al. | 122/248 |
| 3,431,565 | A | * | 3/1969 | Nelson | 4/598 |
| 3,681,788 | A | * | 8/1972 | Le Blanc | A47K 3/325 4/602 |
| 3,687,128 | A | * | 8/1972 | Williams | 122/18.4 |
| 3,709,198 | A | * | 1/1973 | Williams | 122/17.1 |
| 3,738,351 | A | * | 6/1973 | Watts | 122/18.3 |
| 3,768,458 | A | * | 10/1973 | Williams | 122/18.3 |
| 3,773,458 | A | * | 11/1973 | Spotts | 431/156 |
| 3,791,368 | A | * | 2/1974 | Hunt | 126/25 A |
| 3,815,572 | A | * | 6/1974 | Wolfe | 126/59 |
| 3,925,828 | A | * | 12/1975 | Kim | 4/599 |
| 3,935,855 | A | * | 2/1976 | van Vliet | 126/110 R |
| 3,939,503 | A | * | 2/1976 | Nazworth | 4/616 |
| 3,982,695 | A | * | 9/1976 | Burchett et al. | 239/136 |
| 4,053,732 | A | * | 10/1977 | Carter | F24H 3/081 126/101 |
| 4,138,985 | A | * | 2/1979 | Marley | 126/6 |
| 4,184,064 | A | * | 1/1980 | Williams | 392/472 |
| 4,299,194 | A | * | 11/1981 | Miller | 122/33 |
| 4,316,434 | A | * | 2/1982 | Bailey | F22B 27/12 122/155.2 |
| 4,372,198 | A | * | 2/1983 | Stover et al. | 99/340 |
| 4,387,766 | A | * | 6/1983 | Miller | 165/172 |
| 4,453,280 | A | * | 6/1984 | Greenleaf | 4/599 |
| 4,550,689 | A | * | 11/1985 | Wolter | 122/14.21 |
| 4,640,680 | A | * | 2/1987 | Schilling | 431/350 |
| 4,718,601 | A | * | 1/1988 | Chike | 237/16 |
| 4,762,488 | A | * | 8/1988 | Schilling | F23D 14/64 431/350 |
| 4,777,675 | A | * | 10/1988 | Letner | 4/599 |
| 4,893,570 | A | * | 1/1990 | Boucher | F23B 5/04 110/203 |
| 4,954,075 | A | * | 9/1990 | Francino | 431/107 |
| 4,996,970 | A | * | 3/1991 | Legare | 126/205 |
| 5,016,611 | A | * | 5/1991 | Lai | 126/258 |
| 5,111,538 | A | * | 5/1992 | Chapman | 4/599 |
| 5,121,739 | A | * | 6/1992 | Barker | 126/248 |
| 5,125,835 | A | * | 6/1992 | Young | 433/80 |
| D337,815 | S | | 7/1993 | Yoshida | |
| 5,251,345 | A | * | 10/1993 | Pechner | 4/603 |
| 5,267,852 | A | * | 12/1993 | Mizuno | 431/203 |
| 5,441,037 | A | * | 8/1995 | Yen | 126/258 |
| 5,460,161 | A | * | 10/1995 | Englehart et al. | 126/344 |
| 5,465,651 | A | * | 11/1995 | Erickson et al. | 99/330 |
| 5,515,558 | A | * | 5/1996 | Dodge | 4/617 |
| 5,878,928 | A | * | 3/1999 | Seiber | 224/153 |
| 5,911,520 | A | * | 6/1999 | Kenney | 4/615 |
| 5,921,229 | A | * | 7/1999 | Blake | 126/275 R |
| 6,049,919 | A | * | 4/2000 | Roteman | 4/602 |
| 6,059,143 | A | * | 5/2000 | Weir | 222/61 |
| 6,098,214 | A | | 8/2000 | Seiber | |
| 6,209,795 | B1 | * | 4/2001 | Rose | 237/9 B |
| 6,302,094 | B1 | * | 10/2001 | Wehrly et al. | 126/5 |
| 6,354,511 | B1 | * | 3/2002 | Hardee | 237/19 |
| 6,354,571 | B1 | * | 3/2002 | Gerhardy | 261/35 |
| 6,430,760 | B2 | * | 8/2002 | Johns | 4/598 |
| 6,435,174 | B1 | * | 8/2002 | Spilde et al. | 126/378.1 |
| 6,561,183 | B1 | * | 5/2003 | Spilde | F24H 1/06 122/18.2 |
| 6,929,190 | B1 | * | 8/2005 | Adrian | 237/47 |
| 6,978,496 | B2 | * | 12/2005 | Adrian | 4/598 |
| 7,506,386 | B1 | * | 3/2009 | Adrian | 4/598 |
| 8,887,322 | B1 | | 11/2014 | Adrian | |
| 2003/0070430 | A1 | * | 4/2003 | Beckius et al. | 60/645 |
| 2003/0097710 | A1 | * | 5/2003 | Adrian | F24H 1/06 4/598 |

OTHER PUBLICATIONS

U.S. Appl. No. 10/216,496, Oct. 1, 2003, Office Action.
U.S. Appl. No. 10/216,496, Jun. 25, 2004, Office Action.
U.S. Appl. No. 10/216,496, Dec. 16, 2004, Notice of Allowance.
U.S. Appl. No. 10/216,496, Mar. 24, 2005, Notice of Allowance.
U.S. Appl. No. 10/802,426, Dec. 23, 2005, Office Action.
U.S. Appl. No. 10/802,426, Sep. 20, 2006, Office Action.
U.S. Appl. No. 10/802,426, Apr. 2, 2007, Office Action.
U.S. Appl. No. 10/802,426, Dec. 20, 2007, Office Action.
U.S. Appl. No. 10/802,426, Aug. 7, 2008, Office Action.
U.S. Appl. No. 10/802,426, Nov. 12, 2008, Notice of Allowance.
U.S. Appl. No. 12/409,441, Sep. 16, 2010, Office Action.
U.S. Appl. No. 12/409,441, May 23, 2011, Office Action.
U.S. Appl. No. 12/409,441, Aug. 16, 2013, Office Action.
U.S. Appl. No. 12/409,441, Jul. 22, 2014, Notice of Allowance.
U.S. Appl. No. 12/409,441, Sep. 6, 2013, Office Action.

* cited by examiner

PORTABLE WATER HEATER

CROSS-REFERENCE TO RELATED APPLICATIONS

This application claims the benefit of U.S. Provisional Patent Application No. 61/290,687 filed Dec. 29, 2009, and this application is also a continuation-in-part application of U.S. patent application Ser. No. 12/409,441, filed Mar. 23, 2009, which is a continuation of U.S. patent application Ser. No. 10/802,426, filed Mar. 17, 2004, now U.S. Pat. No. 7,506,386, which is a continuation-in-part application of U.S. patent application Ser. No. 10/216,496, filed Aug. 9, 2002, now U.S. Pat. No. 6,978,496, which claims the benefit of U.S. Provisional Patent Application No. 60/311,731, filed Aug. 10, 2001, the disclosures of which are hereby incorporated by reference in their entireties.

BACKGROUND OF THE DISCLOSURE

1. Field of the Disclosure

The present disclosure generally relates to a portable water heater and, in particular, to a portable hot shower for use while camping, boating, hunting, hiking, fishing, backpacking, emergency use, hazardous materials situations, industrial use, etc.

2. Description of Related Art

Various types of devices have been used for many centuries for heating water, but water heaters that are truly portable and easy to use are not readily available. For example, campers and other outdoor enthusiasts requiring hot water often use a fire or cook stove to heat a container of water. The time required to heat even a small amount of water is significant, for example, up to fifteen or twenty minutes to heat a gallon of water.

Portable showers and hot water heaters that can be used in a variety of situations and locations are also known and have been used for many years, but these conventional portable showers often do not provide adequate hot water. For example, in an attempt to keep such showers small and portable, relatively small heat sources have been used. Unfortunately, these small heat sources are usually not powerful enough to provide the desired supply of hot water. Gas powered devices, which provide a larger heat source, have traditionally not been used because of their size and bulk.

Additionally, conventional portable showers often used gravity to deliver the water to the individual taking a shower. The force of gravity, however, often does not provide adequate water pressure or sufficient force to deliver the water as a fine spray. In addition, gravity powered showers require the user to find a location above the head of the user to place a large reservoir of water, which typically contains about two gallons of water and weighs about twenty pounds. It is often difficult to find a sturdy location to place the reservoir of water, especially when camping in remote or desert locations. It can also be difficult and dangerous to lift the relatively heavy reservoir of water into the desired location. Conventional portable showers have also used pumps to increase water pressure, but these pumps often required a large power source that is heavy and awkward to carry over long distances.

Known portable showers often utilize a large container for holding the water. Typically, the water is heated within the container and a pump or gravity is used to supply the heated water from the container to the user. A significant drawback of these known portable showers is that the size of the container limits the amount of hot water available to the user. Thus, if more than one person wants to take a shower, each person must refill the container with cold water, and that water must be heated before that person can take a hot shower. Heating the reservoir of water often takes a significant amount of time, especially if a small heat source is being used. Additionally, these conventional portable showers heat all the water in the container at the same time, requiring a substantial amount of heat from the heat source and a large amount of time to heat all the water in the container. Thus, depending upon the size of the heat source and container, it can take up to thirty minutes or more to heat the water in the container for a hot shower. Disadvantageously, the heated water in the container, which is generally poorly insulated or not insulated at all, typically constantly looses heat, thereby prolonging the time required to heat the water for a hot shower.

Conventional portable showers are often not truly portable because they are heavy, awkward to carry, and include a plurality of parts that must be carefully assembled. In addition, conventional portable showers often require the user to assemble and erect a number of components before the shower can be used. Further, many of these known portable showers are expensive and require complex machinery to heat the water.

It is also known to use solar power for portable showers, but solar heated water is dependent on direct sunlight for heat. Thus, if direct sunlight is not available, for instance on a cloudy day, a hot shower is not available. Further, solar heated systems require sunlight for a large portion of the day in order to sufficiently heat the water. Disadvantageously, this often requires the user to stay in one location for an extended period of time while the water is being heated. Another drawback of solar heated systems is the water container is not typically insulated, which allows a large amount of heat loss through the container. Further, solar heated systems do not work efficiently in low ambient temperature environments.

Therefore, it may be desirable to provide a portable water heater the provides at least one of these advantages.

BRIEF SUMMARY OF THE DISCLOSURE

In one embodiment, a portable water heater is described. The portable water heater includes an elongate housing and a base mounted to the housing. The base includes a plurality of leg or base members pivotably mounted to the base. The portable water heater includes at least one elongate thermal source disposed within the housing. The elongate thermal source being configured to produce thermal energy in the housing. The portable water heater includes a thermal transfer conduit disposed within the housing.

In some embodiments, the base may include a connecting mechanism slidably mounted to at least a portion of the housing and at least one of the plurality of base members may be operatively associated with the connecting mechanism. The portion of the base, in further embodiments, may be collapsible against an exterior surface of the housing.

At least one of the plurality of base members, in some embodiments, may be operatively associated with the housing by a pivoting member. In further embodiments, the pivoting member may be configured to be substantially enclosed by a corresponding base member in a collapsed configuration. The pivoting member, in still further embodiments, may be operatively associated with an intermediate portion of a corresponding base member.

In some embodiments, at least one of the plurality of base members has a substantially concave cross-section. The base, in further embodiments may be at least partially slidably mounted to the housing.

In a further embodiment, a portable water heater is described. The portable water heater includes an elongate housing and a base at least partially slidably mounted to the housing. A portion of the base is collapsible. The portable water heater includes at least one elongate thermal source disposed within the housing. The elongate thermal source is configured to produce thermal energy in the housing. The portable water heater includes a thermal transfer conduit is disposed within the housing.

In some embodiments, a thermal transfer conduit substantially surrounds the at least one elongate thermal source. The thermal transfer conduit, in further embodiments, includes a substantially vertically coiled tubular portion.

A thermal shield, in some embodiments, may be disposed between an interior surface of the housing and an exterior surface of the thermal transfer conduit. In further embodiments, the base includes a plurality of base members.

In a still further embodiment, a portable water heater is described. The portable water heater includes an elongate housing and a base at least partially removably mounted to the housing. A portion of the base is pivotable. The portable water heater includes at least one elongate thermal source disposed within the housing. The elongate thermal source is configured to produce thermal energy in the housing. The portable water heater includes a thermal transfer conduit disposed within the housing.

In some embodiments, an outlet member is in fluid communication with the thermal transfer conduit. The outlet member, in further embodiments, includes two extension members that are telescopically associated and are extendible in length with respect to the housing.

The outlet member, in some embodiments, is rotatable about a longitudinal axis of the housing. In further embodiments, the portable water heater includes a second outlet member in fluid communication with the thermal transfer conduit. The outlet member, in still further embodiments, is a garden hose. In some embodiments, the portable water heater includes a rigid storage container configured to store the portable water heater in a disassembled state.

These and other aspects, features and advantages of the present disclosure will become more fully apparent from the following description of the preferred embodiments and appended claims.

BRIEF DESCRIPTION OF THE DRAWINGS

The appended drawings contain figures of preferred embodiments of the portable water heater, which illustrate some of the above-recited and other aspects, features and advantages of the present disclosure. It will be appreciated, however, that the illustrated drawings only illustrate preferred embodiments of the disclosure and are not to be considered limiting of its scope. The disclosure will be described and explained with additional specificity and detail through the following figures.

DETAILED DESCRIPTION OF THE PREFERRED EMBODIMENTS

The present disclosure involves a portable water heater that can be used to provide a hot shower in a variety of environments and locations. The principles of the present disclosure, however, are not limited to portable water heaters for hot showers. It will be understood that, in light of the present disclosure, the portable water heater can be successfully used in connection with other types of devices and uses, such as used for cooking and cleaning. Further, the water heater is also useful where larger quantities of water are needed, such as in, but not limited to, military, disaster or hazardous waste clean-up, fire, hospital, decontamination, and other similar settings. More broadly, the portable water heater can be used in almost any location to which a user is able to transport it, so that it is available for any reason that the user might need a running water supply.

Additionally, to assist in the description of the portable water heater, words such as top, bottom, front, rear, right and left are used to describe the accompanying figures. It will be appreciated, however, that the portable water heater can be located in a variety of desired positions—including various angles, slopes and inclines. A detailed description of the portable water heater now follows.

Figure 1:
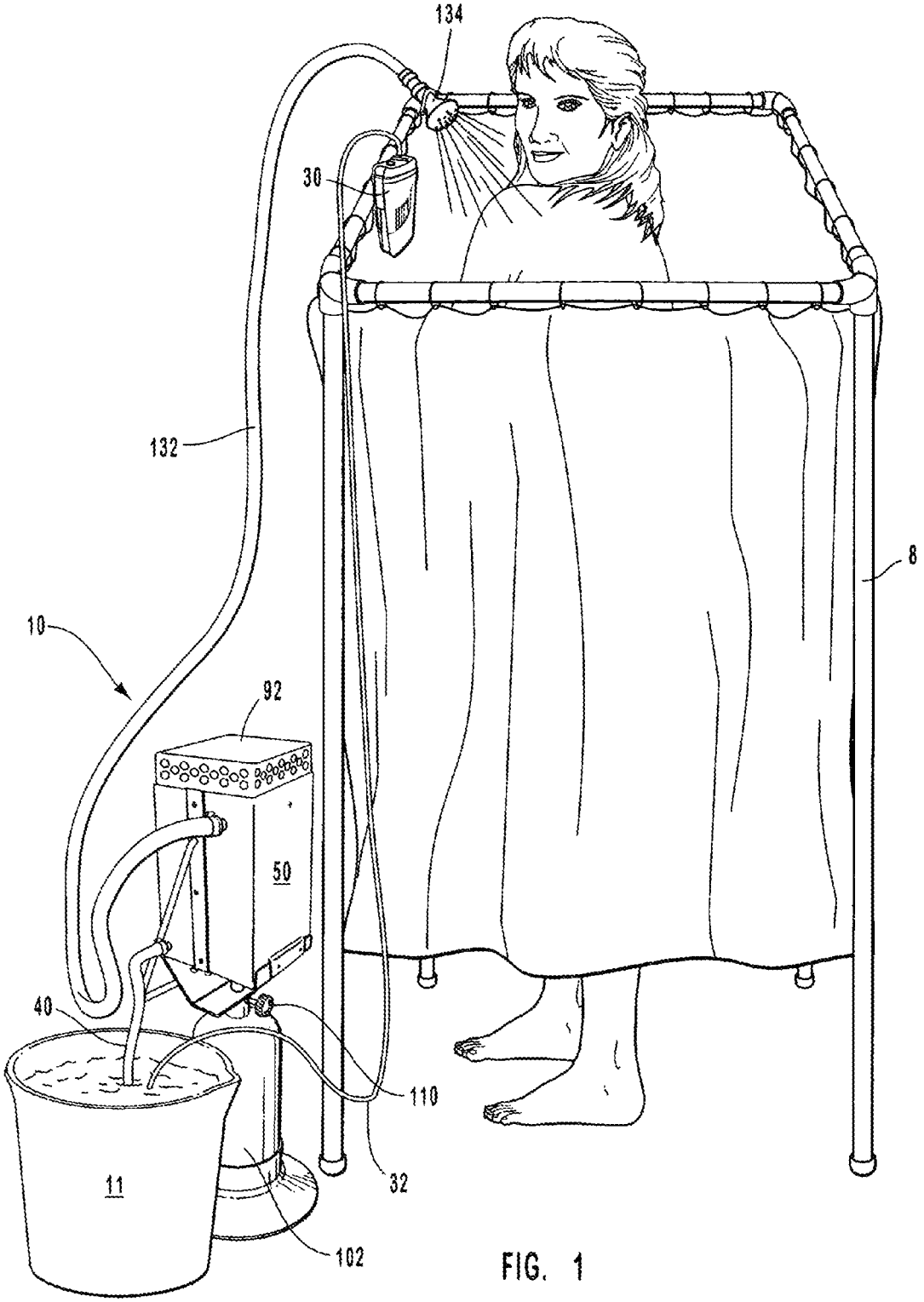
FIG. 1 illustrates a perspective view of one embodiment of the portable water heater, illustrating the portable water heater being used as a shower.

As seen in FIG. 1, a portable water heater 10 can be used to provide a hot shower to a user in a variety of locations. For example, portable water heater 10 allows a user to take a hot shower while camping, hiking, climbing, backpacking, etc. The shower can be used in conjunction with a privacy enclosure 8, if so desired. Alternatively, portable water heater 10 can be used any time hot water is desired, such as for cooking and cleaning.

Figure 2:
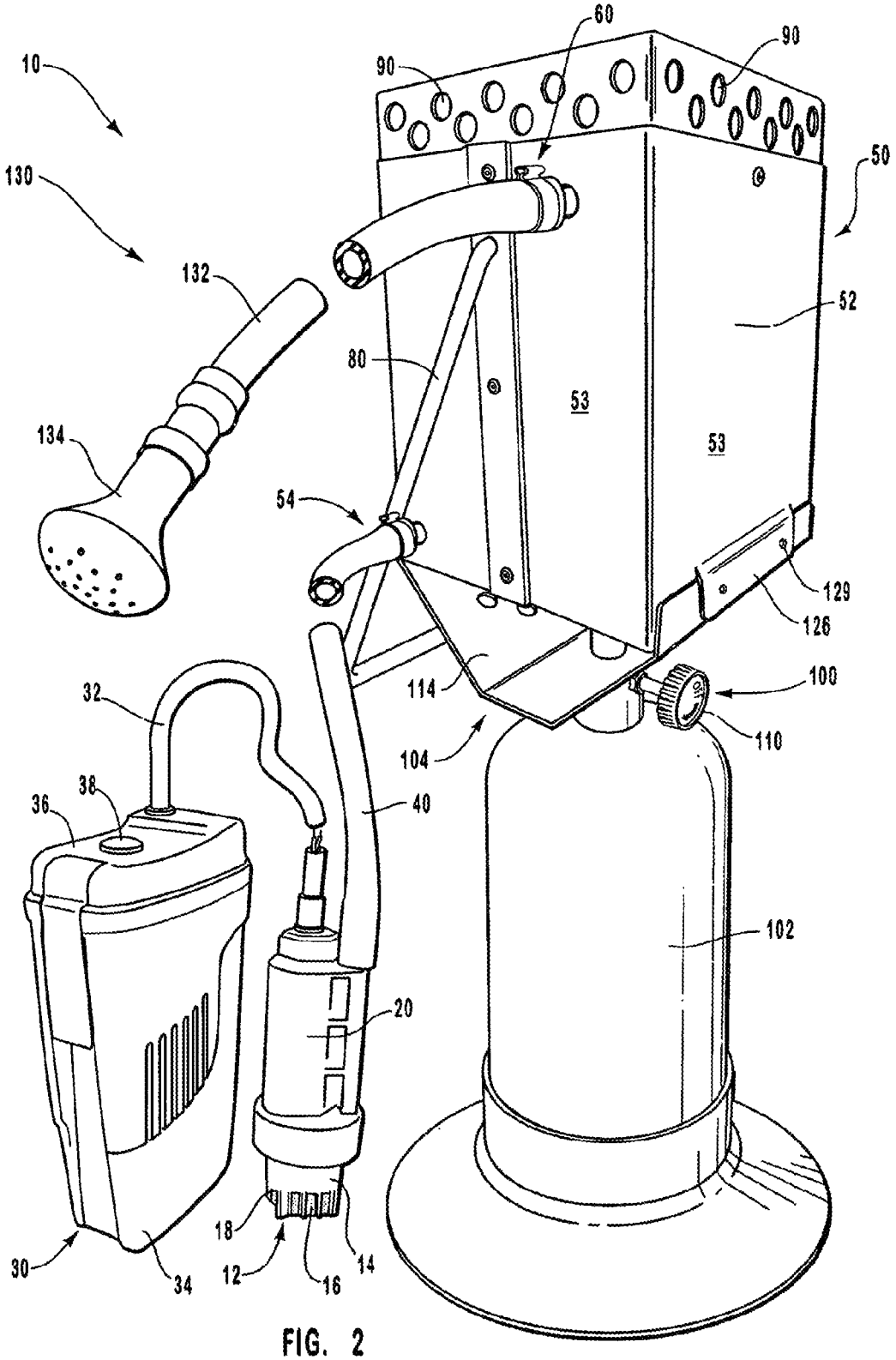
FIG. 2 is a partially exploded perspective view of the portable water heater shown in FIG. 1.

FIG. 1 depicts one embodiment of portable water heater 10 which includes a power supply 30 and heating assembly 50. A pump 20 (not shown) is disposed in a water source 11. As seen in FIG. 2, pump 20 includes an intake 12 that allows water or other suitable types of fluids from water source 11 to enter the device. Intake 12 desirably includes a removable cover 14 with a series of openings 16 to allow the water to enter pump 20. Intake 12 may also include a filter 18 that prevents foreign objects or other unwanted debris from entering the device. Advantageously, in one embodiment, cover 14 is threadably connected to intake 12 of pump 20 such that cover 14 can be removed and cleaned, and this also allows intake 12 to be directly connected to a water source such as a hose. It will be appreciated that cover 14 could also be attached using a snap fit or various other methods of retaining cover 14 on pump 20 which are known in the art.

As shown in FIGS. 1 and 2, pump 20 is disposed in water source 11 to draw water into portable water heater 10. In one embodiment, pump 20 is encased in a durable material such as plastic to protect it from damage, and to allow pump 20 to be submerged in water. The design and configuration of intake 12 and pump 20 allow portable water heater 10 to be used in a wide variety of locations and environments because intake 12 and pump 20 can simply be inserted into any suitable water source 11, such as a lake, stream, pond or river. Advantageously, intake 12 and pump 20 can also be used in connection with other types of water sources 11, such as a culinary water supply, water container or reservoir.

Pump 20 is preferably sized and configured to supply a sufficient volume of water for bathing or showering. The volume of water delivered by pump 20 may be dependent upon factors such as the size and speed of the pump. Thus, the size and speed of pump 20, for example, may be varied depending upon the intended use of portable water heater 10. That is, pump 20 may be differently sized or configured if portable water heater 10 is intended to be used for showering or for cooking. Additionally, although in one embodiment pump 20 is depicted as being located near or formed in conjunction with intake 12, pump 20 could be located in any suitable location or portion of water heater 10 and still perform the function thereof with intake 12 being a separate member located remote from pump 20.

Power supply 30 is electrically connected to pump 20 by an electrical line 32. As shown in FIG. 2, power supply 30 includes a container 34 with a lid 36 and an on/off switch 38 for selectively controlling the flow of power to pump 20. In one embodiment, lid 36 is movingly attached to container 34. It will be appreciated that lid 36 could be attached to container 34 by hinges or by a resilient material that allows lid 36 to be selectively attached to container 34. Further, lid 36 and or container 34 of power supply 30 may include one or more inwardly extending bumps or protrusions that engage the lid 36. In another embodiment, lid 36 could be selectively attached to container 34 by a sliding arrangement formed on both lid 36 and container 34 such that when lid 36 is slidingly mounted on container 34 it cooperates therewith to removably lock in place. Various methods of moveably attaching or fasting lid 36 to container 34 may be utilized.

Power supply 30 may include batteries. In one embodiment illustrated in FIG. 2, power supply 30 uses multiple "D" sized batteries (not shown) that are inserted into container 34 to supply power to pump 30. More specifically, in one embodiment, power supply 30 includes four "D" sized batteries. Depending on the size of power supply 30 and/or amount of water to be heated by portable water heater 10, various other numbers, sizes, and/or types of batteries may be utilized. The batteries used in power supply 30 may be replaceable or rechargeable, or power supply 30 may comprise a sealed battery. It will be appreciated that power provided by power supply 30 may vary according to the size and power requirements of pump 20. For example, a larger power supply 30 may be required for a larger pump 20 while a smaller power supply may be used with a smaller pump. Additionally, power may also be supplied by any suitable power source such as a car, recreational vehicle or boat battery, a cigarette lighter in a car or boat, connection to an electrical outlet or power grid, gasoline powered or other type of auxiliary motor, generator, or the like.

As depicted in FIG. 1, intake 12 and pump 20 are in fluid communication with an intake tube 40. In one embodiment, intake tube 40 is constructed from a resilient flexible material and allows the water to flow directly from pump 20 to a heating assembly 50. Advantageously, pump 20 provides pressurized water for the user and, when portable water heater 10 is being used in conjunction with a shower, the force of gravity is not required to cause the water to flow from water source 11 to a showerhead 134. In contrast, many conventional portable showers require the user to place a heavy reservoir of water above the individual using the shower and then use the force of gravity to cause the water to the flow to the showerhead.

In one embodiment depicted in FIG. 2, heating assembly 50 of portable heater 10 includes a housing 52. In this embodiment, housing 52 includes four sidewalls 53 and has a generally rectangular configuration. In one embodiment, housing 52 has a length and a width of about five inches and a height of about six inches, but it will be understood that housing 52 may have any desired size depending upon various factors such as the rate at which water is to be heated.

Figure 7:
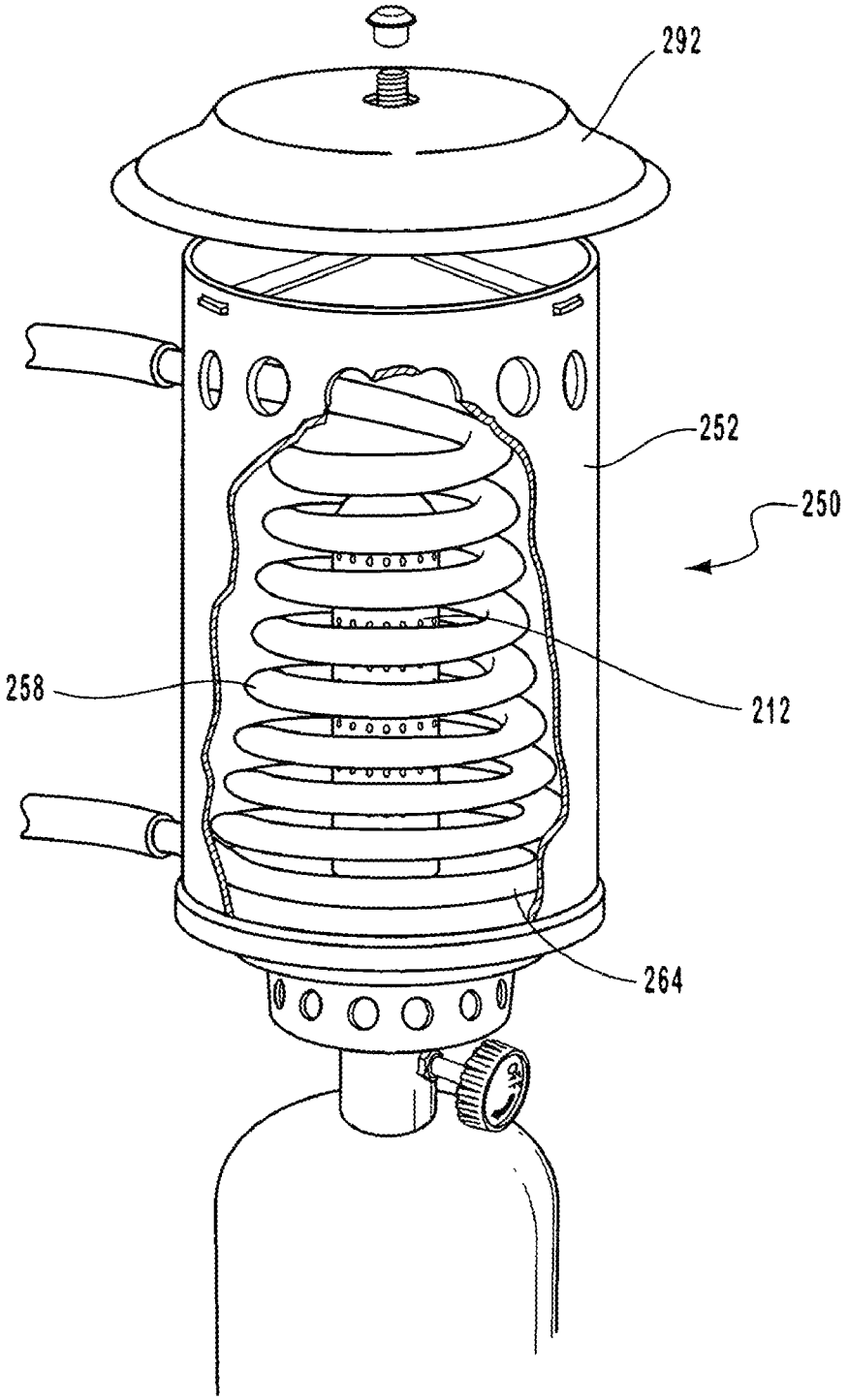
FIG. 7 is a partial perspective view of another embodiment of a heating assembly.
Figure 17:
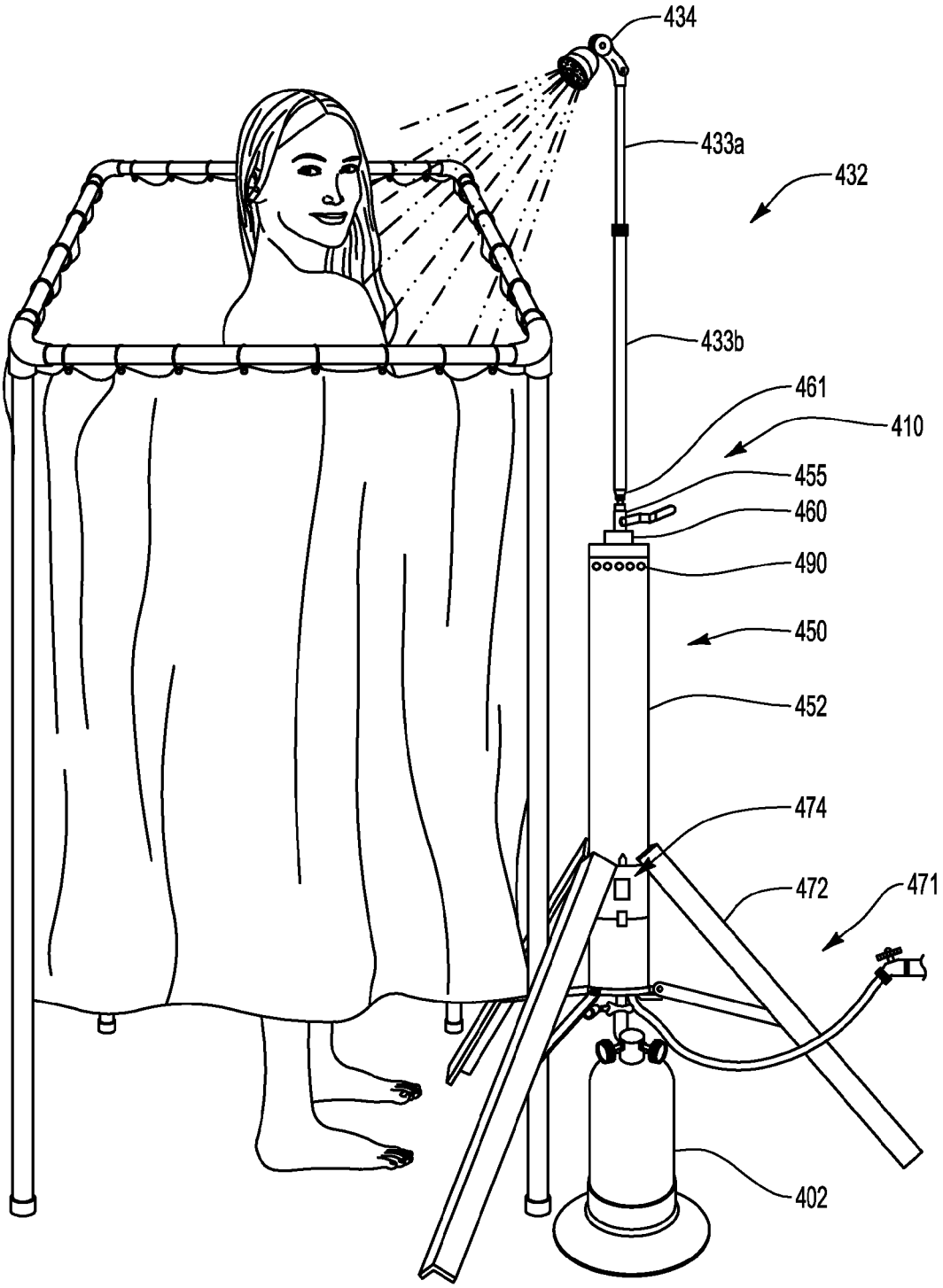
FIG. 17 illustrates a perspective view of a further embodiment of a portable water heater, illustrating the portable water heater being used as a shower.

It will be appreciated that housing 52 could have various other numbers of sidewalls 53 and still perform the function thereof. In addition, it will be appreciated that housing 52 could have various other configurations and perform the function thereof. By way of example and not limitation, housing 52 could be square, cylindrical, oval, elliptical, and the like or combinations thereof. For example, FIGS. 7 and 17 illustrate embodiments of heating assembly 250 and heating assembly 450, respectively, where housing 252 and housing assembly 452 have by way of example and not limitation a generally cylindrical configuration.

Figure 4:
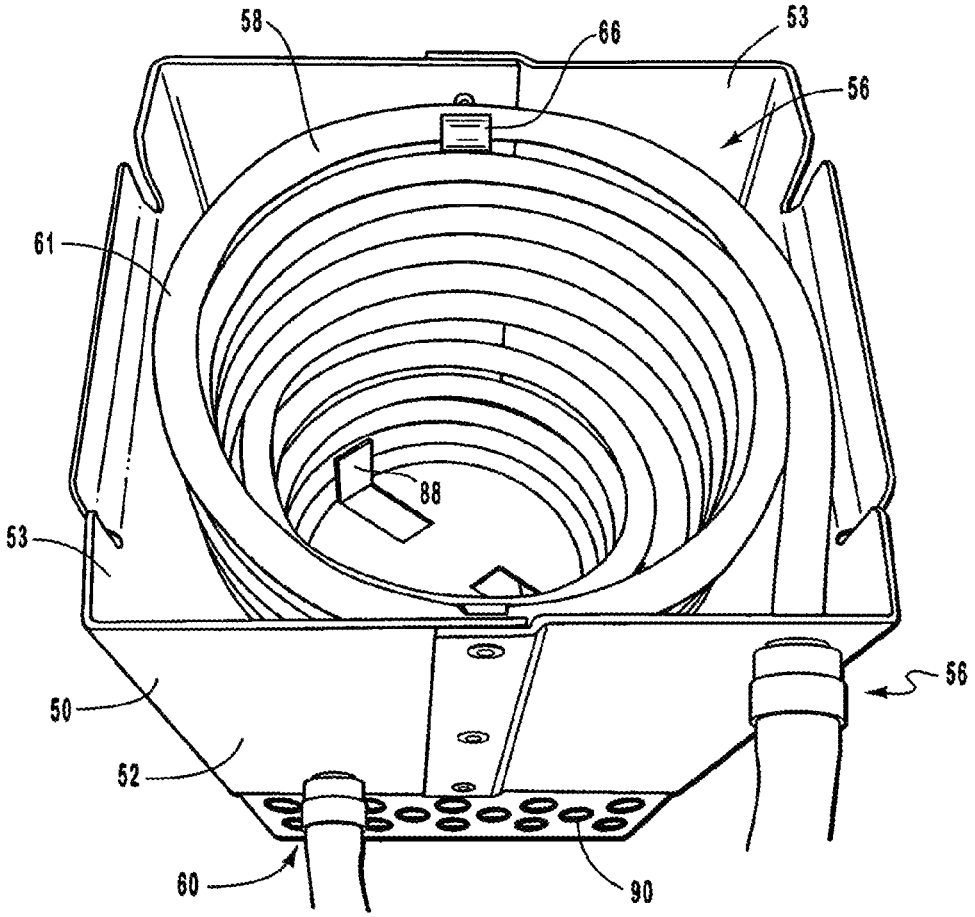
FIG. 4 is a perspective view from the bottom and looking toward the top of a portion of the portable water heater shown in FIG. 1, illustrating one embodiment of a heating assembly.
Figure 5:
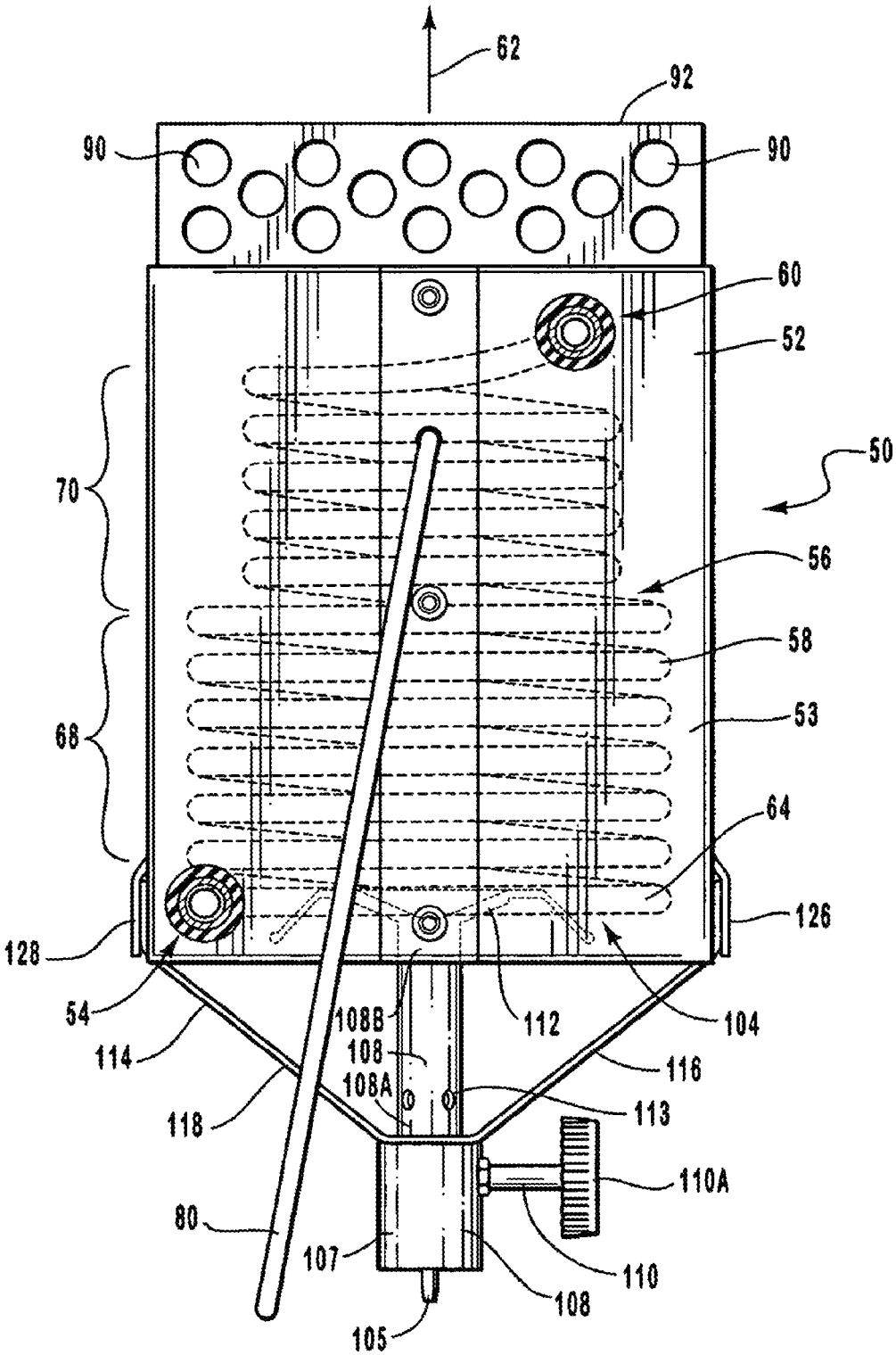
FIG. 5 is a side view of a portion of the portable water heater shown in FIG. 1, illustrating a one embodiment of a heating assembly and one embodiment of a fuel burner assembly.
Figure 6:
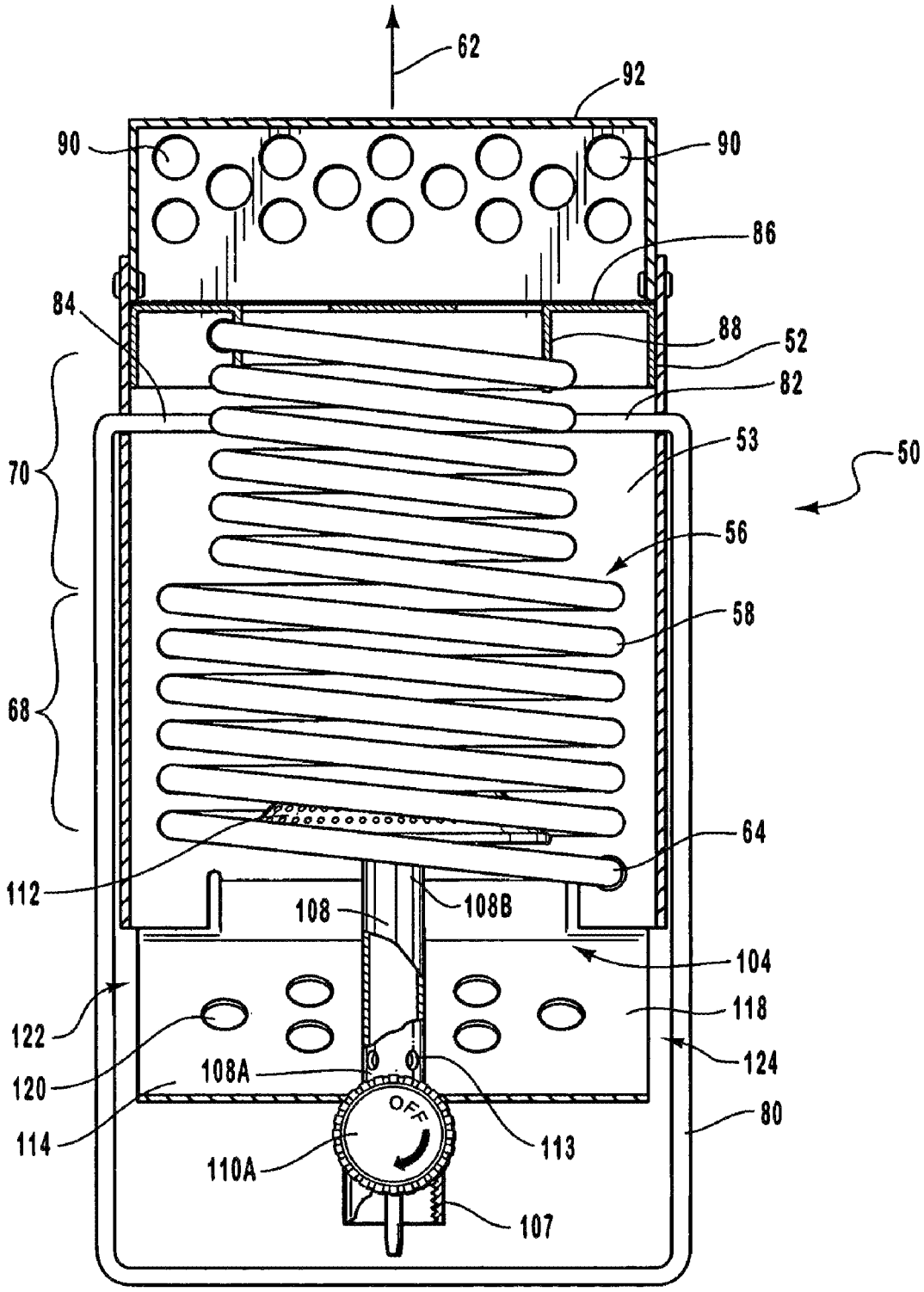
FIG. 6 is a partial cross sectional side view of the portion of the portable water heater shown in FIG. 5.

As illustrated in FIGS. 1 and 2, in one embodiment heating assembly 50 also includes an inlet 54 that is disposed on one side of housing 52 and it is connected to intake tube 40. In other embodiments, inlet 54 may be disposed on another side, the top, bottom, or other portion of the housing 52. Inlet 54 allows the water to flow into a heat transfer conduit 56 (see FIG. 4) disposed inside housing 52. As shown in FIGS. 4-6, in one embodiment heat transfer conduit 56 includes an elongated coiled tube 58 that spirals upwardly within housing 52 towards an outlet 60.

Portable water heater 10 also comprises a heat transfer means for transferring the heat produced by a fuel burner 112 (FIG. 3) to water flowing through heat transfer means. One example of structure capable of performing the function of such a heat transfer means includes heating assembly 50. In one embodiment, heating assembly 50 comprises heat transfer conduit 56 disposed in housing 52. It will be appreciated various other embodiments of structure are capable of performing the function of such a heat transfer means.

In one embodiment shown in FIG. 4, tube 58 includes a plurality of closely spaced coils having one or more different diameters D relative to the longitudinal axis of heat transfer conduit 56 that decrease in length as tube spirals upwardly. In one embodiment, decrease in diameter D of the coils results in heat transfer conduit 56 having a conical-like shape. More specifically, in one embodiment illustrated in FIGS. 4-6, coiled tubing 58 of heat transfer conduit 56 is generally disposed about a generally centrally located vertical axis 62 within housing 52. A first coil 64 is located proximate the lower end of housing 52 and is attached to sidewalls 53 of housing 52 by bracket 66 (FIG. 4). In one embodiment, two brackets 66 are used to attach first coil 64 to the lower end of housing 52. It will also be appreciated that various other numbers of brackets 66 may be used to carry out the function thereof. Brackets 66 hold tubing 58 of first coil 64 in a generally stationary position, but may allow some amount of movement, such as expanding movement, for example, while the water is heated as it flows through portable water heater 10. It will be appreciated that various types of fastening or connecting methods could be used to generally keep tubing 58 of first coil 64 in place with respect to housing 52.

In one embodiment, first coil 64 has an inside diameter such that the outer portion of coil 64 is disposed proximate, or actually touches, sidewalls 53 of housing 52. In one embodiment depicted in FIGS. 5 and 6, first coil 64 is part of a first series of coils 68 that spiral generally upwardly. This first set of coils 68 in one possible embodiment has an inside diameter X that is about four inches or smaller.

In one embodiment shown in FIGS. 5 and 6, coiled tubing 58 of heat transfer conduit 56 also includes a second set of coils 70 that have an inside diameter Y that is smaller than the inside diameter X of the first set of coils 68. In one embodiment, second set of coils 70 has an inside diameter Y of about three inches, but one skilled in the art will appreciate that second set of coils 68 may have any suitable diameter depending, for example, upon the size of housing 52, the rate at which water is to be heated or the diameter of the tubing. It will be appreciated that heat transfer conduit 56 could have various other configurations and perform the function thereof. For example, first set 68 and second set 70 of coiled tubing could be each in the shape of two cylindrical portions joined together. Alternatively, first set 68 and second set 70 of coiled tubing 58 could be configured to form a conical shape or two conical shapes that are joined together. In addition, by way of example and not limitation, first set 68 and second set 70 of coiled tubing 58 of heat transfer conduit 56 could be reversed.

FIG. 7 depicts another embodiment of heating assembly 250 which includes another possible embodiment of coiled tubing 258. As seen in FIG. 7, in this embodiment coiled tubing 258 has a generally conical shape. By way of example and not limitation, coiled tubing 258 has a generally conical shape with a generally decreasing radius. As illustrated, coiled tubing 258 has generally constantly decreasing radius. It will be appreciated that various other configurations of coiled tubing 258 are capable of performing the function thereof. Further, it will be appreciated that coiled tubing 258 may have any suitable radius depending, for example, upon the size of the housing 252, the volume of water to be heated or the diameter of the tubing.

Figure 8:
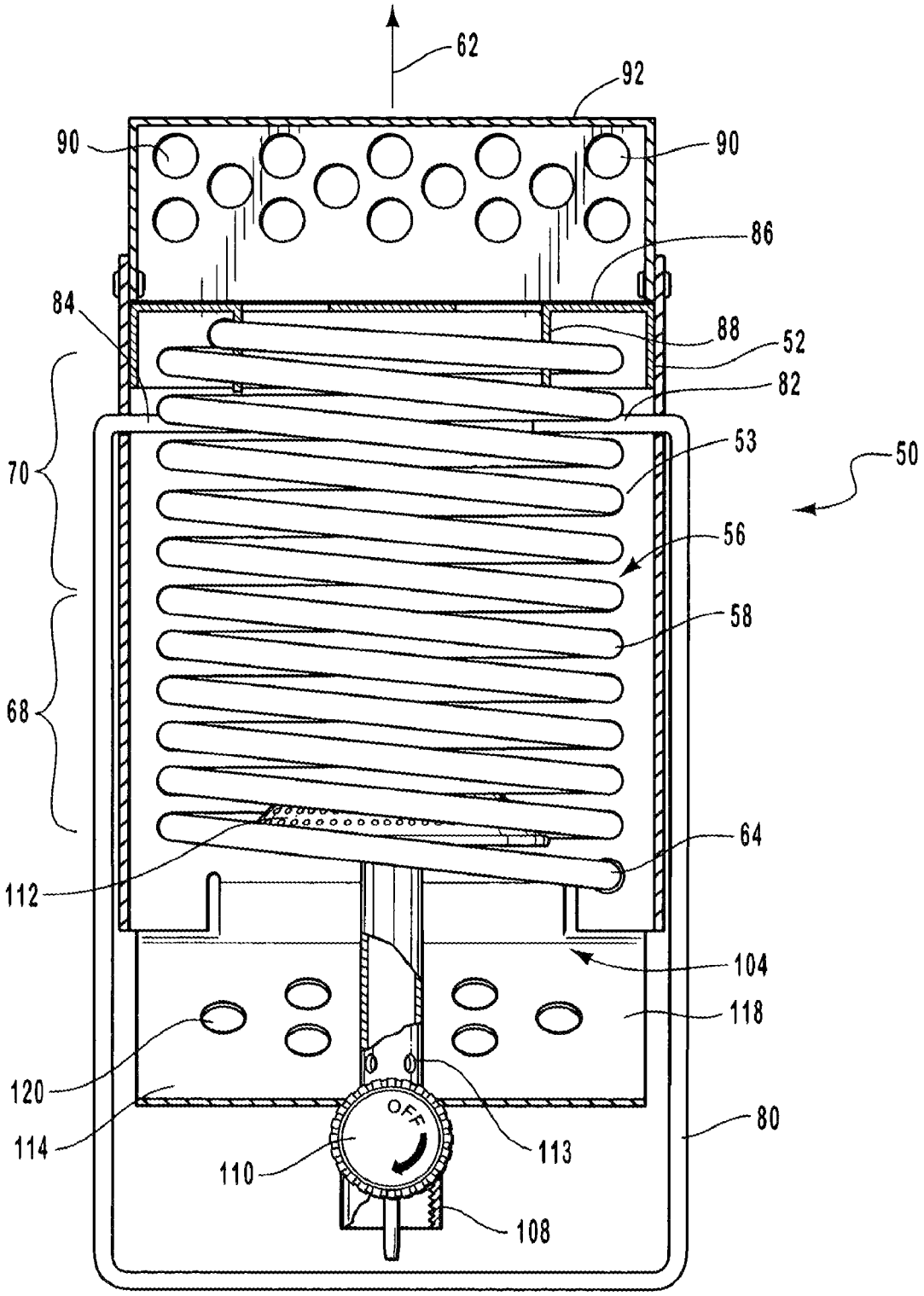
FIG. 8 is a partial cross sectional side view of a portion of the portable water heater shown in FIG. 6, illustrating another possible embodiment of a heating assembly.

FIG. 8 depicts another embodiment of heat transfer conduit 56 for heating assembly 50 of a portable water heater 10. As illustrated, heat transfer conduit 56 includes coiled tubing 58 in a generally cylindrical shape with substantially only one diameter Z. In other words, heat transfer conduit 56 is substantially all the same diameter Z.

In the various configurations for heat transfer conduit 56, coiled tubing 58 is sized and positioned to efficiently heat the water passing there through. In particular, heat transfer conduit 56 is configured to effectively and efficiently heat the water as it flows to the shower. For example, the individual coils of the tubing 58 are preferably spaced apart to allow air to flow around the tubes. This space between the coils allows the entire outer surface of the coil to be heated, thereby increasing the efficiency of portable heater 10. However, the coils of tubing 58 are still spaced close enough to each other to allow heat from one coil to be transferred to an adjacent coil to further increase the efficiency of portable water heater 10.

In one embodiment, coiled tubing 58 is spaced apart by a distance of about 0.25 inches to about 0.125 inches. However, it will be appreciated by one skilled in the art that various other suitable distances may be used to separate the coils. One skilled in the art will appreciate that coiled tubing 58 may also be divided into various other numbers of series of coils and that the coils or series of coils may have any suitable diameters. By way of example and not limitation, one skilled in the art will appreciate that coiled tubing 58 might alternatively be divided into three or more series of coils and perform the function thereof.

In addition, one or more of the adjacent coils of coiled tubing 58 may touch one another and still perform the function thereof. Further, it will be appreciated that coiled tubing 58 may have other suitable arrangements and configurations, such as conical that are appropriate for the intended use of portable water heater 10.

In one embodiment, coiled tubing 58 is constructed from a material, such as copper, that facilitates rapid heat transfer. Various other suitable types of materials including other metals, such as aluminum or stainless steel, may also be used. Additionally, in one embodiment, coiled tubing 58 may extend generally from the lower portion of housing 52 to the upper portion of housing 52 such that the tubing generally fills the heating assembly 50. This configuration may advantageously increase the heat transfer achieved by heat transfer conduit 56 by providing a large amount of surface area of coiled tubing 58 while simultaneously minimizing the size of the housing 52.

As shown in FIG. 2, a handle 80 is attached to housing 52 of heating assembly 50 to facilitate carrying of portable water heater 10. Handle 80 is in one embodiment pivotally attached to housing 52 and allows heating assembly 50 to be attached to a support if desired. FIGS. 5 and 6 illustrate in further detail that in one embodiment handle 80 is attached to housing 52 by inserting a first end 82 of handle 80 through a hole in a sidewall 53 of housing 52, and a second end 84 of the handle through a hole in an opposing sidewall 53. In one embodiment of handle 80, first and second ends 82, 84, respectively, of handle 80 have a length sufficient to extend through the holes in sidewalls 53 and between two adjacent coils of the tubing 58. Alternatively, first and second ends 82 and 84, respectively are long enough to extend through the holes in the particular side wall 53 of housing 52 and past the inside diameter of coiled tubing 58. However, in this embodiment, by way of example and not limitation, first end 82 and second end 84 are on opposing ends of handle 80 and are not connected. In this particular embodiment first end 82 and second end 84 of handle 80 are retained therein by conventional movable attachment methods.

Advantageously, in these embodiments first and second ends 82 and 84, respectively, of handle 80 help position and secure coiled tubing 58 within the housing 52. Of course, handle 80 may be attached to the housing 52 in a variety of ways. Various other configurations of handle 80 are capable of carrying out the function thereof. For example, first and second ends 82 and 84, respectively, are not required to extend past the inner diameter of coiled tubing 58. In fact, in another embodiment, first and second ends 82 and 84, respectively, of handle 80 may only extend just past side wall 53 of housing 52.

Housing 52 also includes an upper inner surface 86, as shown in FIG. 6, disposed near the top of housing 52. In one embodiment of portable water heater 10, inner surface 86 includes brackets 88 that help hold coiled tubing 58 in the desired position. As illustrated, in one embodiment, two brackets 88 are used to hold coiled tubing 58 in place. It will be appreciated that various other numbers of brackets 88 could be utilized to hold coiled tubing 58 in place. Various other fastening or retaining methods could be used in housing 52 to retain coiled tubing 58 in position.

Housing 52 of heating assembly 50 also includes a plurality of apertures 90 disposed in the upper portion of sidewalls 53 to allow the flow of air and gas to exit heating assembly 50 which will be discussed in further detail. Additionally, in one embodiment housing 52 has a generally flat, planar upper surface 92 that advantageously allows items to be placed on upper surface 92 of heating assembly 50. Advantageously, food, small articles of clothing, or other objects may be heated on upper surface 92 of housing 52 while portable water heater 10 is operating. Upper surface 92 also helps to prevent rain and other items from entering heating assembly 50 when the portable water heater is being used outdoors. In alternative embodiment shown in FIG. 7, housing 252 has an upper surface 292 is that removably attached to the housing 252.

It will be appreciated that while apertures 90 are depicted as being round in one embodiment, apertures 90 may have various other shapes and configurations. By way of example and not limitation, apertures 90 may be oval, elliptical, octagonal, square, rectangular, or the like, or any combination thereof. In addition, it is contemplated that upper surface 92 may have apertures 90 formed therein.

Returning to FIG. 2, attached to the lower portion of housing 52 of heating assembly 50 is a heat source 100 that includes a fuel source 102. Fuel source 102 is preferably a container or tank of combustible gas, such as propane, but other suitable types of fuel may also be used. In one embodiment, the container for fuel source 102 is a pressurized cylinder of gas that contains about 16.4 ounces of fuel, but it may contain any desirable amount of gas depending upon the intended use of the portable water heater 10. It will be appreciated that various other sizes of containers for fuel source 102 may be utilized. It is contemplated that the size of fuel sources that are readily available can be utilized. In addition, various other sizes of containers may be used. By way of example and not limitation, the container of fuel source 102 may include up to five gallons, or more, of gas for extended use of portable water heater 10 in a remote cabin or at a large campsite with numerous people. Similarly, it is contemplated that the container for fuel source 102 may be of the style often used for campers, barbeques and the like. Alternatively, the container for fuel source 102 may include only a few ounces of gas for use by backpackers, hikers and mountain climbers.

Figure 3:
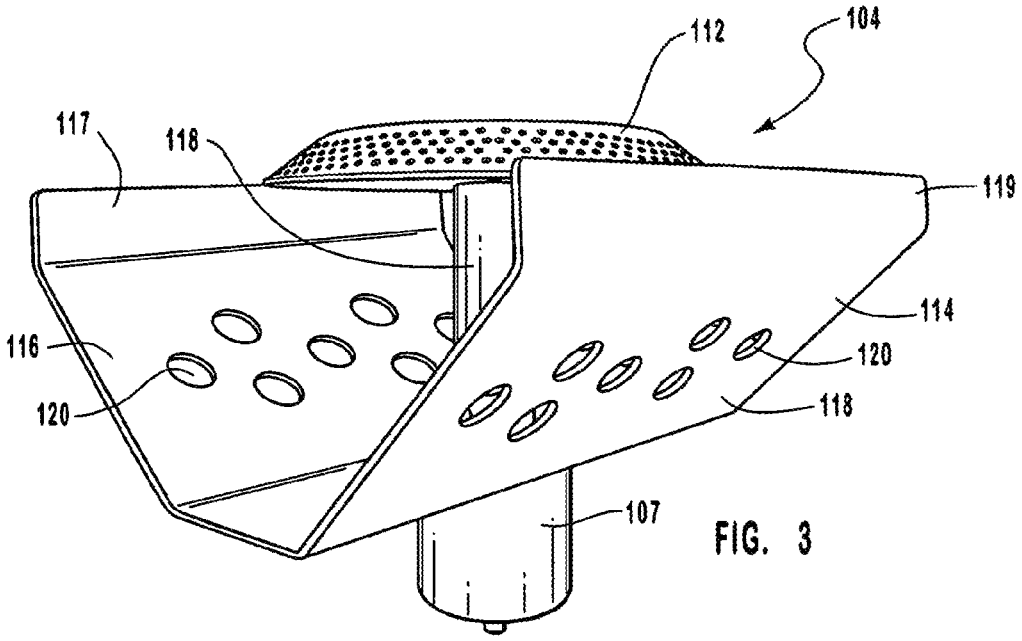
FIG. 3 is a perspective view of a portion of the portable water heater shown in FIG. 1, illustrating one embodiment of a fuel burner assembly.

In one embodiment heat source 100 also includes a fuel burner assembly 104, which combusts fuel to create heat in heating assembly 50. FIG. 3, depicts one embodiment of fuel burner assembly 104. As illustrated in FIG. 3, in one embodiment fuel burner assembly 104 includes a connector 107 which connects fuel burner assembly 104 to fuel source 102 (see FIG. 1). As illustrated in FIG. 3, connector 107 connects fuel source 102 (see FIG. 1) to a fuel conduit 108.

Turning now to FIGS. 5 and 6, in one embodiment fuel conduit 108 has a first end 108A and a second end 108B. Second end 107B of connector 107 is attached to first end 108A of fuel conduit 108. Fuel conduit 108 also includes openings 113 that are spaced about fuel conduit 108 to allow air to be mixed with the fuel to promote efficient burning of the fuel. Accordingly, openings 113 are sized and configured to create the proper air-fuel mixture for efficient combustion of the fuel. In one embodiment, fuel conduit 108 has four openings 113 formed therein. It will be appreciated by one skilled in the art that various other numbers of openings 113 could be utilized to carry out the function thereof. Further, in one embodiment, openings 113 are equally spaced about the circumference of fuel conduit 108. It will be appreciated that various other configurations of openings 113 may be utilized to carry out the intended function thereof.

Burner 112 of fuel burner assembly 104 is attached to the second end 108B of fuel supply tube 108 and includes a plurality of openings to release the fuel-air mixture where the flame will occur. Fuel burner assembly 104 is connected to fuel source 102 (not shown) by connector 107. As illustrated most clearly in FIG. 6, in one embodiment, connector 107 is connected to fuel source 102 (not shown) by threads that allows fuel burner assembly 104 to be releasably connected to fuel source 102. Connector 107, as shown in FIGS. 5 and 6, includes a control valve 110 that controls the flow of fuel from fuel source 102 to fuel burner assembly 104. Control valve 110 has a control knob 110A attached thereto and is disposed in connector 107 to selectively control the flow of fuel through connector 107. A needle 105 extends from connector 107 into the outlet of fuel source 102 (not shown) to enable fuel from the fuel source to flow into connector 107.

FIG. 7 illustrates another embodiment of fuel burner assembly 104. In this embodiment burner 212 is configured to extend vertically along the central axis of coiled tubing 258 disposed in one embodiment of heating assembly 250 and housing 252. One advantage of this embodiment is that because one or more of sections of the coils of coiled tubing 258 decrease in diameter as coiled tubing 258 spirals upwardly, at greater portion of coiled tubing 258 are directly exposed to the heat from burner 212. In other words, where coiled tubing 258 is configured as illustrated in FIG. 7, least some if not all of the lower and upper coils of coiled tubing 258 are directly exposed to the heat from the burner 212.

Turning back to FIG. 3, a shield 114 is attached to fuel conduit 108. In one embodiment, shield 114 includes two opposing, upwardly extending sidewalls 116, 118. In one embodiment, sidewalls 116 and 118 are extending angularly away from each other in an upward direction. It will be appreciated that sidewalls 116 and 118 could be oriented in different configurations. By way of example and not limitation, shield 114 may have sidewalls 116 and 118 which extend substantially vertically upward. Accordingly, shield 114 could be shaped as an open box-like structure.

In one embodiment of shield 114 depicted in FIGS. 3 and 6, sidewalls 116, 118 of shield 114 include a plurality of openings 120 to allow air to be introduced into heating assembly 50. It will be appreciated that while openings 120 are in one embodiment depicted as being round, openings 120 may have various other shapes such as being oval, elliptical, square, rectangular, octagonal or the like or combinations thereof. In one embodiment, shield 114 also includes open opposing ends 122, 124 to allow additional air to be introduced into heating assembly 50. Advantageously, shield 114 allows a large quantity of air to be introduced into heating assembly 50 while also protecting burner 112 from damage and generally preventing the user or other objects from touching the burner or contacting the burning gas.

In one embodiment, shown in FIG. 5, the upper portions of sidewalls 116, 118 of shield 114 are separated by generally the same distance as sidewalls 53 of housing 52 such that heat source 100 can be readily attached to heating assembly 50. As a result, the upper portions 117, 119 of sidewalls 116, 118 are configured to be inserted into corresponding flanges 126, 128 in housing 52 to create a friction engagement of heat source 100 to heating assembly 50. It will be appreciated that various other ways of attaching shield 114 to housing 52 could be utilized.

By way of example and not limitation, sidewalls 116, 118 of shield 114 may be either slightly compressed or expanded to create a more secure connection of heat source 100 to heating assembly 50. As illustrated in FIG. 2, in one embodiment, flanges 126, 128 of housing 52 may include one or more inwardly extending bumps or protrusions 129 that engage sidewalls 116, 118 of shield 114 (see FIG. 5). Advantageously, this friction and/or compression engagement of heat source 100 and heating assembly 50 creates a secure, but releasable connection that allows portable water heater 10 to be easily assembled and disassembled. Alternatively, in another embodiment heat source 100 and heating assembly 50 are connected by any suitable means well known in the art such as rivets, screws, hinges, welding, glue, and the like.

Returning to FIG. 5, advantageously, heating assembly 50 and heat source 100 (FIG. 2) efficiently heat the water traveling through coiled tubing 58 because burner 112 is located near coiled tubing 58. Further, in one embodiment, because one or more of the coils of tubing 58 decrease in diameter as coiled tubing 58 spirals upwardly, at least some if not all of the lower and upper coils 58 are directly exposed to the heat from burner 112. Alternatively, where coiled tubing 58 forms a generally cylindrical shaped body, coiled tubing 58 allows the heat from burner 112 to flow upwardly past the coils without being impeded.

Shield 114 also increases the efficiency of portable shower heater 10 by directing the heat from burner 112 toward coiled tubing 58. More specifically, in one embodiment, angled sidewalls 116, 118 of shield 114, which is constructed from metal, assist in directing the heat from burner 112 towards coiled tubing 58, and housing 52, which is constructed from metal, also helps direct the heat from burner 112 to coiled tubing 58. It will be appreciated that various types of materials capable of withstanding heat may be utilized as the coiled tubing 58 and/or housing 52.

In one embodiment, illustrated in FIG. 6, upper inner surface 86 of housing 52 helps retain the heat from burner 112 within the housing while allowing the combustion gases to escape through the apertures 90 near the top of sidewalls 53 of housing 52. Thus, heating assembly 50 provides for efficient heating of the water due to the effective heat transfer from the heat source to the water, and the loss of heat from heating assembly 50 is minimized.

Referring to FIG. 2, an outlet assembly 130 is attached to the upper portion of heating assembly 50 to allow the water to flow from the coiled tubing 58 into an outlet conduit 132. More specifically, outlet conduit 132 is connected to outlet 60. In one embodiment, outlet conduit 132 is comprised of a resilient, flexible material. It will be appreciated that outlet conduit 132 may have various configurations and perform the function thereof. A fixture 134, such as a showerhead, may be attached to outlet conduit 132 depending upon the intended use of water heater 10. It will be appreciated that other suitable types of fixtures 134, or no fixture at all, may be used depending upon the intended use of portable water heater 10.

The portable water heater 10 may also include a carrying case (not shown) that allows the device to be easily transported and assembled. The carrying case desirably allows all the components of portable water heater 10 to be stored when it is not in use. Advantageously, the carrying case can also be used to store and contain water for the water heater 10. That is, the carrying case can be filled with water to serve as water source 11 for portable water heater 10.

In greater detail, the carrying case preferably includes a recessed handle and a removable lid. The removable lid is preferably releasable attached to a body of the carrying case by two or more hinges that allow the lid to be removed. The removable lid includes a recessed portion or cavity that is sized and configured to receive all or a portion of water heater 10. In one embodiment, the recessed portion is sized and configured to receive and hold one or more pressurized gas cylinders in an upright position. Advantageously, the lid provides a sturdy and stable base for portable water heater 10, whether or not the lid is attached to the body of the carrying case. A preferred embodiment of the carrying case is disclosed in co-pending U.S. provisional patent application Ser. No. 60/312,550, filed on Aug. 15, 2001, to which U.S. patent application Ser. No. 10/222,732, filed on Aug. 15, 2002 claims priority and the benefit thereof, the disclosure of which is hereby incorporated by reference in its entirety.

As illustrated in FIGS. 1-3, in order to assemble portable water heater 10, fuel burner assembly 104 with gas burner 112 is connected to fuel source 102, such as a pressurized cylinder 106 filled with propane. In particular, fuel conduit 108 allows fuel burner assembly 104 to be quickly and easily connected to the pressurized cylinder that is the fuel source 102 by simply screwing or twisting fuel burner assembly 104 on to fuel source 102. Heating assembly 50 may then be connected to heat source 100 by a friction and/or compression fit. In one embodiment, housing 52 of heating assembly 50 includes a pair of flanges 126, 128 that allow heat source 100 to be securely fastened to heating assembly 50. Alternatively, heating assembly 50 and heat source 100 may be permanently connected by means such as by riveting or welding. One skilled in the art will appreciate that portable water heater 10 can also be assembled in other desired sequences and orders.

In operation, intake 12 is inserted into or connected to water source 11 such that water is provided to portable water heater 10, and power is supplied to pump 20 by power supply 30. For example, the user can insert intake 12 and pump 20 into a bucket of water as shown in FIG. 1, and the user can depress the on/off switch 38 on power supply 30 to turn pump 20 on and draw water from water source 11 through intake 12. The user then turns on heat source 100 by opening gas control valve 110 and igniting the gas either manually or automatically. Thus, water is now flowing through water heater 10 and the water is being heated by heat source 100. One skilled in the art will appreciate that the volume of water being pumped is generally dependent upon the size and speed of the pump. Thus, the speed or size of the pump can be increased to supply a larger volume of water.

In greater detail, the water flows through pump 20, intake tube 40, intake 12, and into heating assembly 50 where the water enters heat transfer conduit 56. As the water traverses heat transfer conduit 56, heat from heat source 100 heats the water. In particular, coiled tubing 58 absorbs the heat from heat source 100, and transfers the heat to the water as it flows through coiled tubing 58. In one embodiment coiled tubing 58 spirals upwardly and has a decreasing diameter, such that the coils assume a conical shape, exposing at least some of the upper coils directly to the heat from heat source 100. Advantageously, this configuration increases the transfer of heat from heat source 100 to the water because more of the coils are heated to a higher temperature. Additionally, as discussed above, coiled tubing 58 is spaced apart to facilitate heating of coiled tubing 58 and to allowing hot air and gases to flow around coiled tubing 58. This arrangement further increases the heat transfer between the heat source 100 and coiled tubing 58. Advantageously, because heat transfer conduit 56 has a large surface area, is located proximate to heat source 100, and is constructed from materials that facilitate the transfer of heat, the water is quickly and efficiently heated. In one embodiment, coils are formed in a generally cylindrical shape. In this embodiment heating of the water is obtained efficiently because of the large surface area, proximity to heat source 100 and is constructed from materials made to efficiently transfer heat.

The heated water then exits heating assembly 50 through outlet 60 and enters outlet assembly 130. More specifically, water enters outlet conduit 132. Outlet conduit 132 is connected to any suitable fixture 134, such as a showerhead, which can be used for any desirable task or undertaking such as taking a shower.

Once hot water from water heater 10 is no longer needed, the user simply extinguishes heat source 100 by turning control valve 110 into the off position and turning pump 20 off. Extinguishing heat source 100 stops the heating of the water, and turning off pump 20 stops the flow of water through water heater 10. The user can then detach intake tube from either pump 20 or inlet 54 and allow the water to drain from portable water heater 10. Portable water heater 10 is now ready to be disassembled, moved or transported. Advantageously, portable water heater 10 can also be quickly disassembled for storage or transport. For example, heating assembly 50 can be disconnected from heat source 100, and fuel burner assembly 104 can be disconnected from fuel source 102. This disconnected state allows the various components to be stored in a relatively small area, such as inside the carrying case.

Turning now to FIGS. 9 through 16, another embodiment of a portable water heater 300 is illustrated containing features of the present disclosure. Water heater 300 includes many of the features and functions as the other portable water heaters disclosed herein. Water heater 300 provides one possible alternative configuration for the components thereof. In one embodiment, water heater 300 can be used in more commercial or industrial settings where a larger volume of water is required. Water heater 300 is also useful where larger quantities of water are needed, such as in, but not limited to, military, emergency, disaster or hazardous waste clean-up, fire, hospital, decontamination, and other similar settings. However, water heater 300 may also be used in more personal settings as described above.

Figure 9:
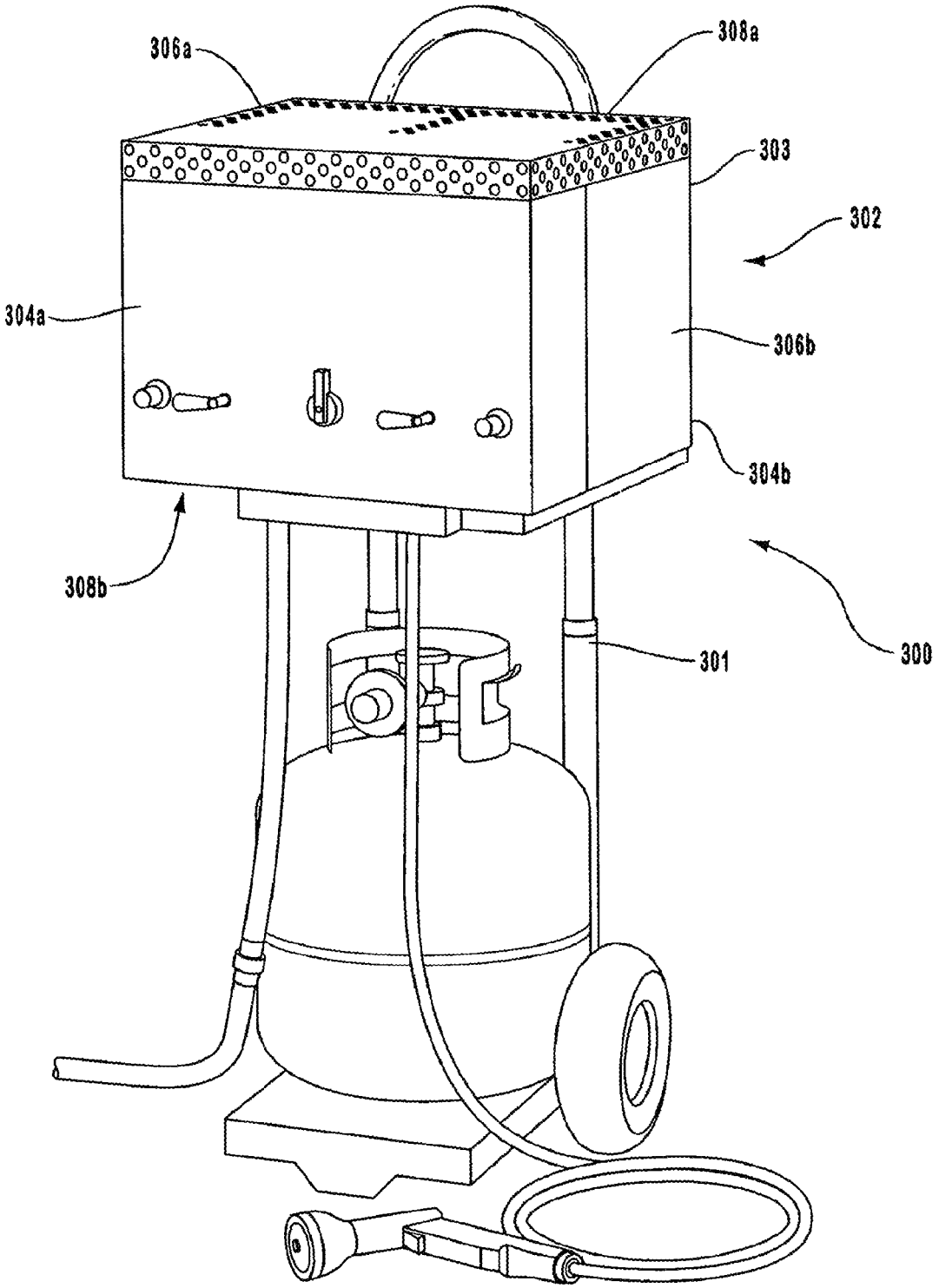
FIG. 9 is a perspective view of another embodiment of a portable water heater for use in larger scale applications.
Figure 10:
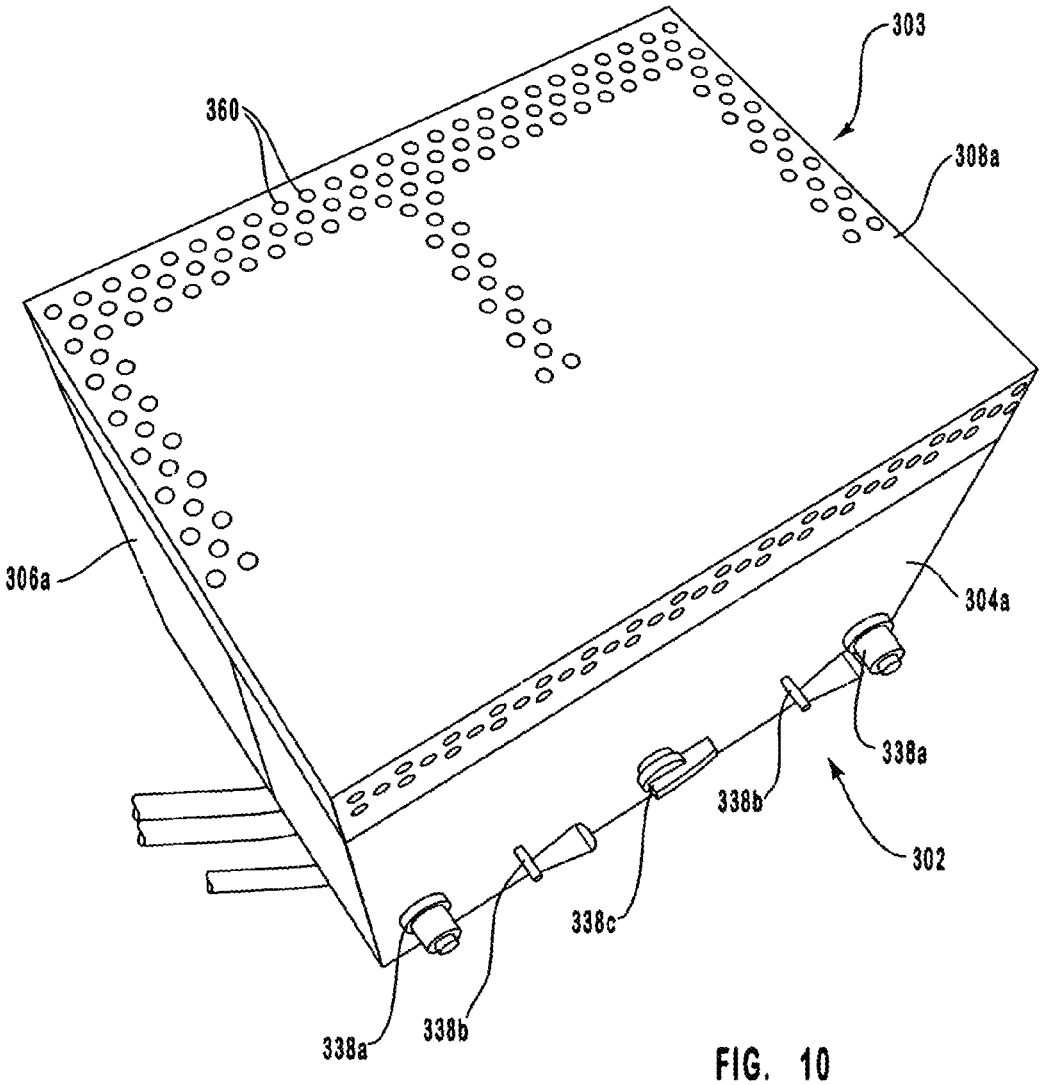
FIG. 10 is a perspective view of the heating assembly of FIG. 9, viewing the heating assembly from the top and illustrating the top cover attached.
Figure 11:
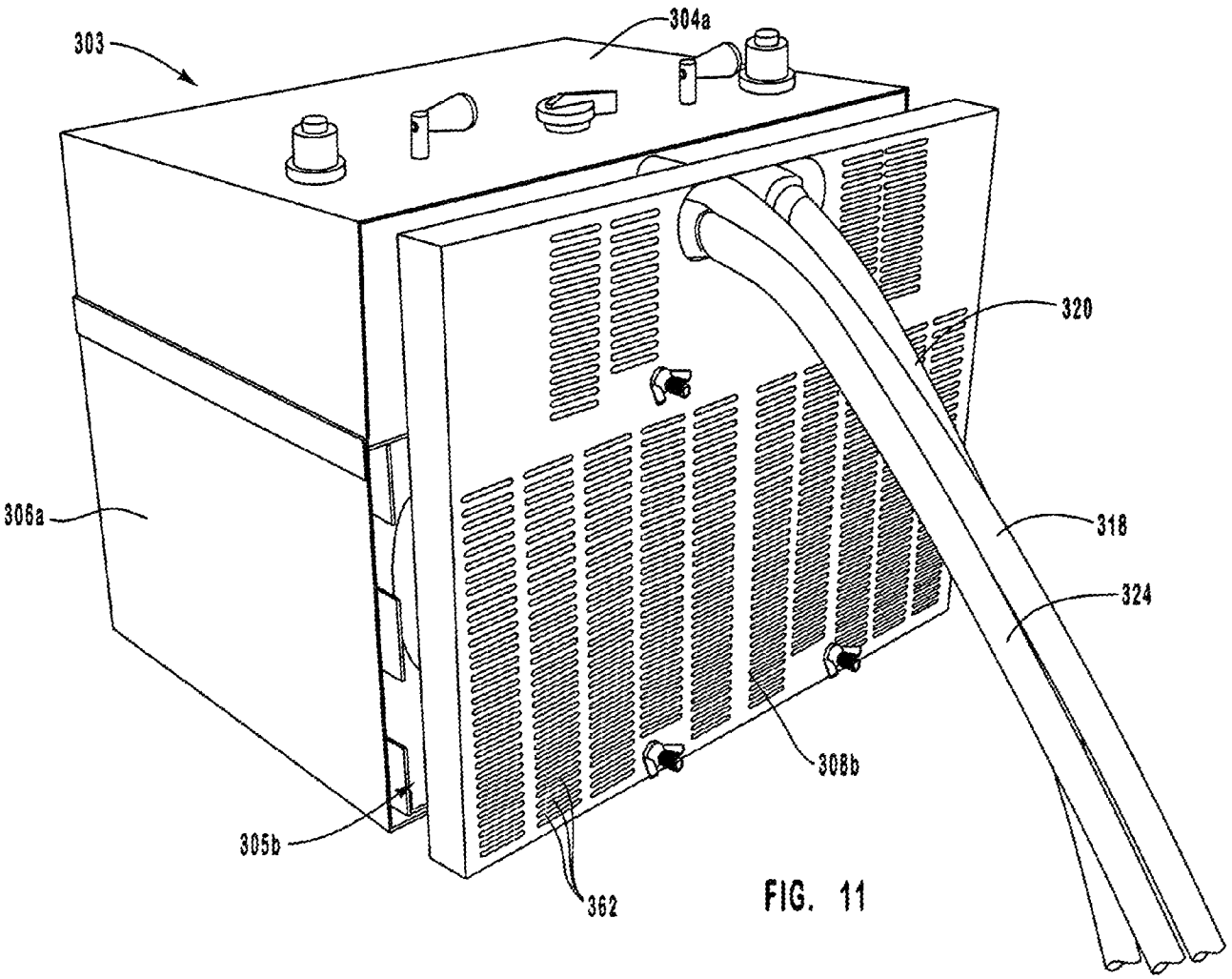
FIG. 11 is a perspective view of the heating assembly of FIG. 9, viewing the heating assembly from the bottom and illustrating the bottom cover attached.
Figure 12:
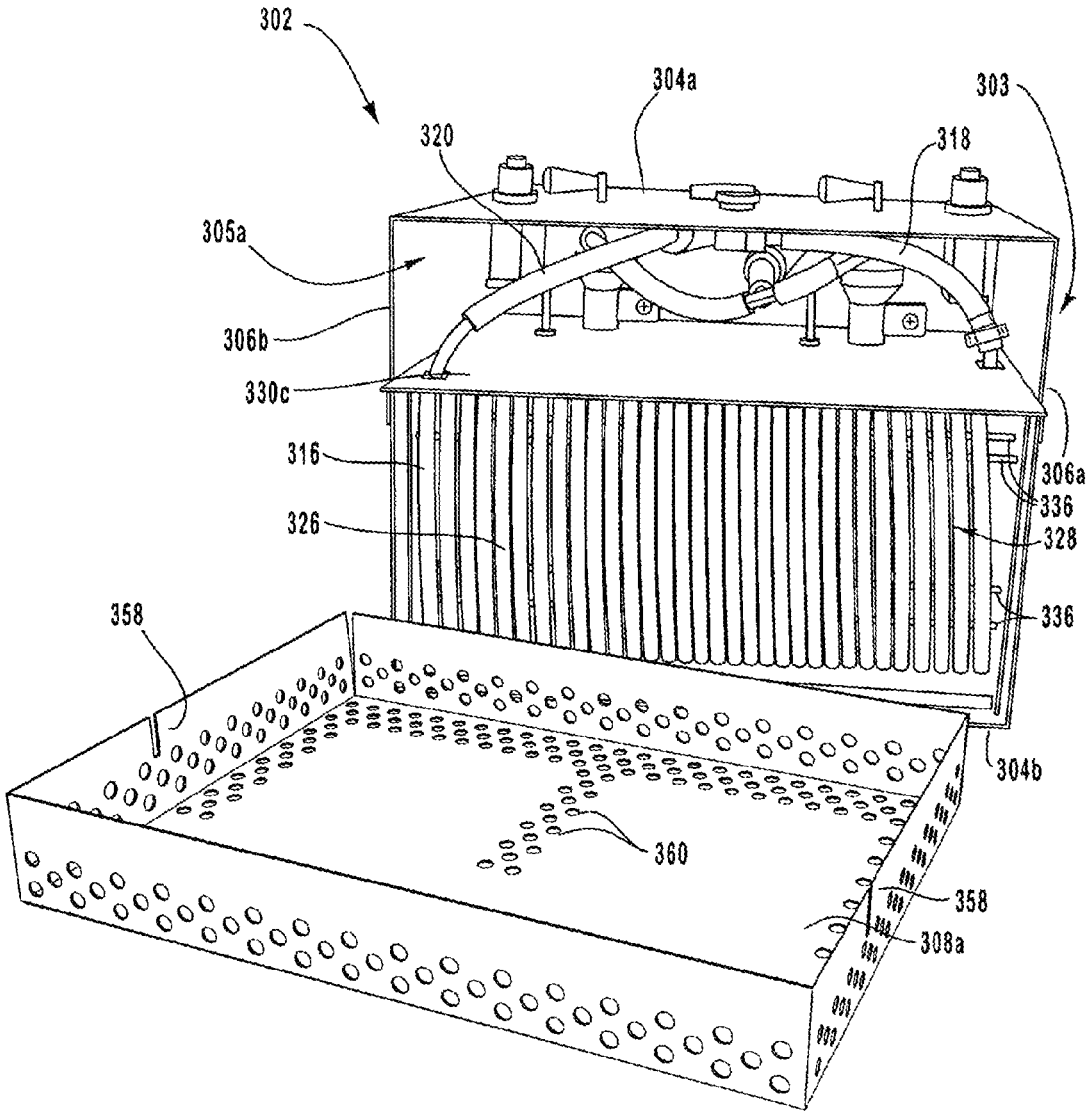
FIG. 12 is a perspective view of the heating assembly of FIG. 9, viewing the heating assembly from the top and illustrating the top cover removed.
Figure 14:
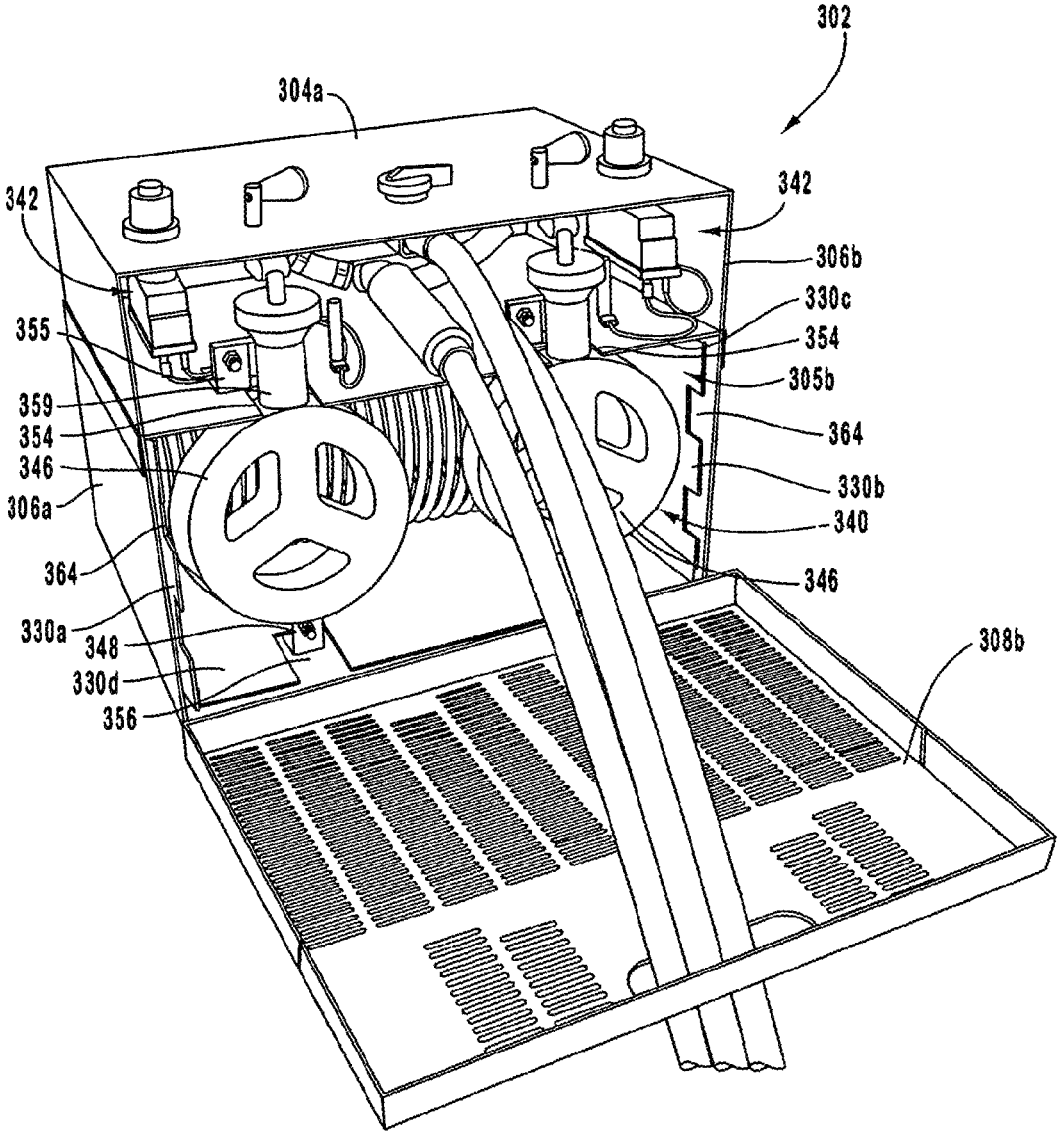
FIG. 14 is a perspective view of the heating assembly of FIG. 9, viewing the heating assembly from the bottom and illustrating the bottom cover removed.

As shown in FIGS. 9 and 10, a heating assembly 302 has an outer housing 303. In one possible embodiment, outer housing 303 is formed by a front wall 304*a*, rear wall 304*b*, sidewalls 306*a* and 306*b*, top cover 308*a* and bottom cover 308*b*. As shown in FIGS. 12 and 14, respectively, walls 304*a*, 304*b*, 306*a*, 306*b* form a top opening 305*a* (FIG. 12) and a bottom opening 305*b* (FIG. 14). A top cover 308*a* (illustrated in FIG. 10) is configured to be disposed over the top opening 305*a* and a bottom cover 308*b* (shown in FIG. 11) can be disposed over the bottom opening 305*b*.

Figure 15:
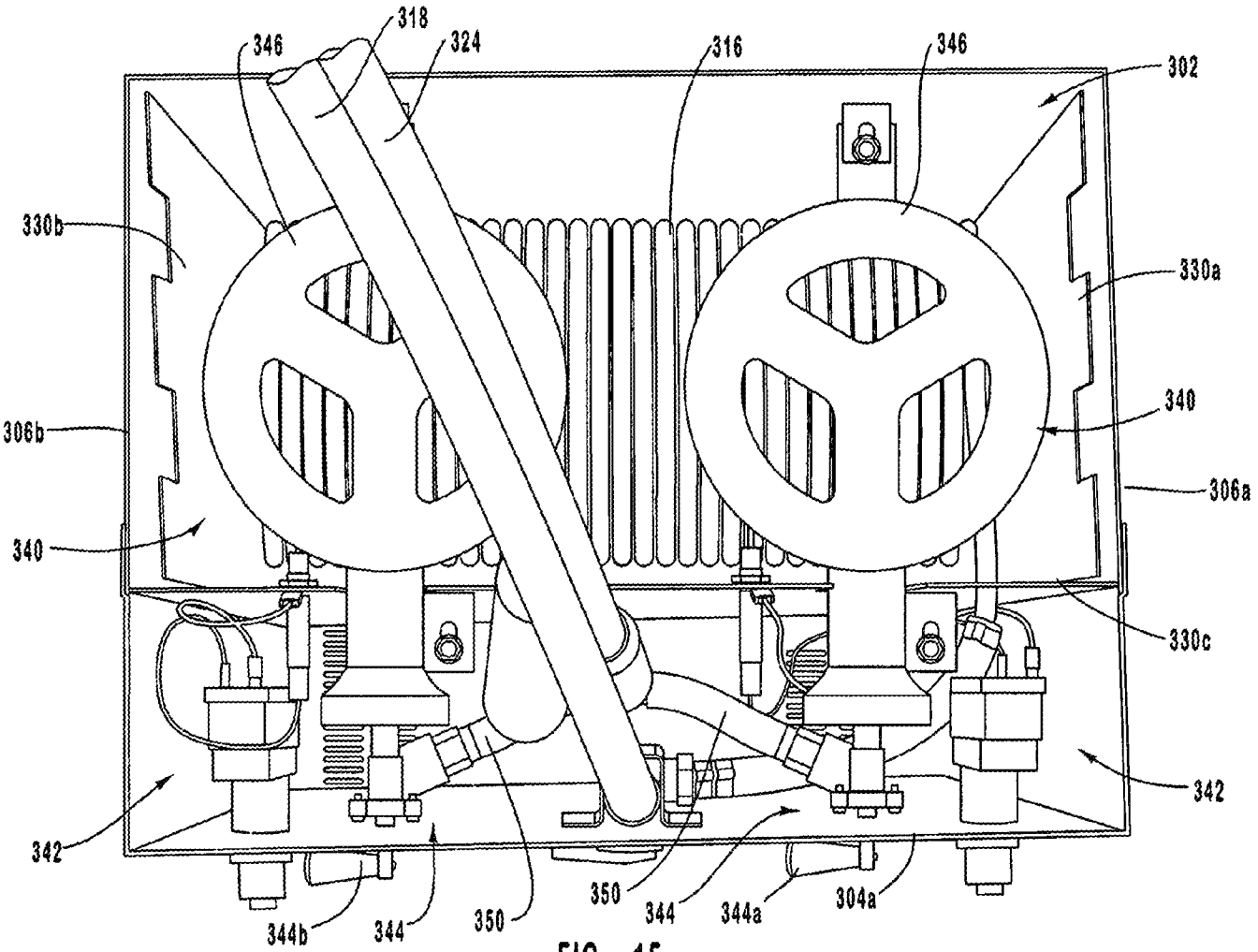
FIG. 15 is a bottom plan view of the heating assembly of FIG. 9, with the bottom cover removed.

As illustrated in FIG. 15, heating assembly 302 includes a heat transfer conduit 316 and burner assembly 340 discussed in more detail below. As discussed above, the water heaters of the present disclosure can be used for many personal applications such as providing hot showers. For larger, more industrial applications, the size of the water heater may be increased to accommodate a larger volume of water.

Returning to FIG. 13, in one embodiment, portions of outer housing 303 can further be constructed in sections forming a front portion 310*a* and a rear portion 310*b*. Front portion 310*a* is substantially U-shaped structure, the base of the U-shaped structure forming the front wall 304*a* and the legs 311*a* of the U-shaped structure forming a portion of sidewalls 306*a*, 306*b*. Rear portion 310*b* is correspondingly substantially U-shaped in construction. The base of the U-shaped structure of portion 310*b* forms rear wall 304*b* and the legs 311*b* form a portion of sidewalls 306*a*, 306*b*. In addition, in one embodiment, the legs 311*b* of rear portion 310*b* include inwardly bent first lip 312*a* and second lip 312*b* at the ends thereof. It will be appreciated that various other configurations could be used to form outer housing 303 such as pieces joined the corners to form walls 304*a*, 304*b*, 306*a*, 306*b*. In another embodiment, walls 304*a*, 304*b*, 306*a*, 306*b* could be integrally formed.

Returning to FIG. 10, front wall 304*a* may include a plurality of holes to allow portions of components of the burner assembly and/or heat transfer conduit to be accessible outside outer housing 303, which will be discussed in more detail below. Outer housing 303 may include other features not shown in the embodiment of FIGS. 9 and 10, including, but not limited to, a handle, apertures in outer housing 303 for releasing heat, apertures for connecting portions of outer housing 303 together, and the like. Furthermore, it will be appreciated that outer housing 303 may have various other configurations for performing the functions described herein.

As shown in FIG. 9, in one application, heating assembly 302 is mounted on a portable platform such as a dolly 301. It will be appreciated that heating assembly 302 can also be mounted to various other mobile structures, such as, but not limited to, a cart, other wheeled structures, skis, sleds, tracks, and the like.

Figure 13:
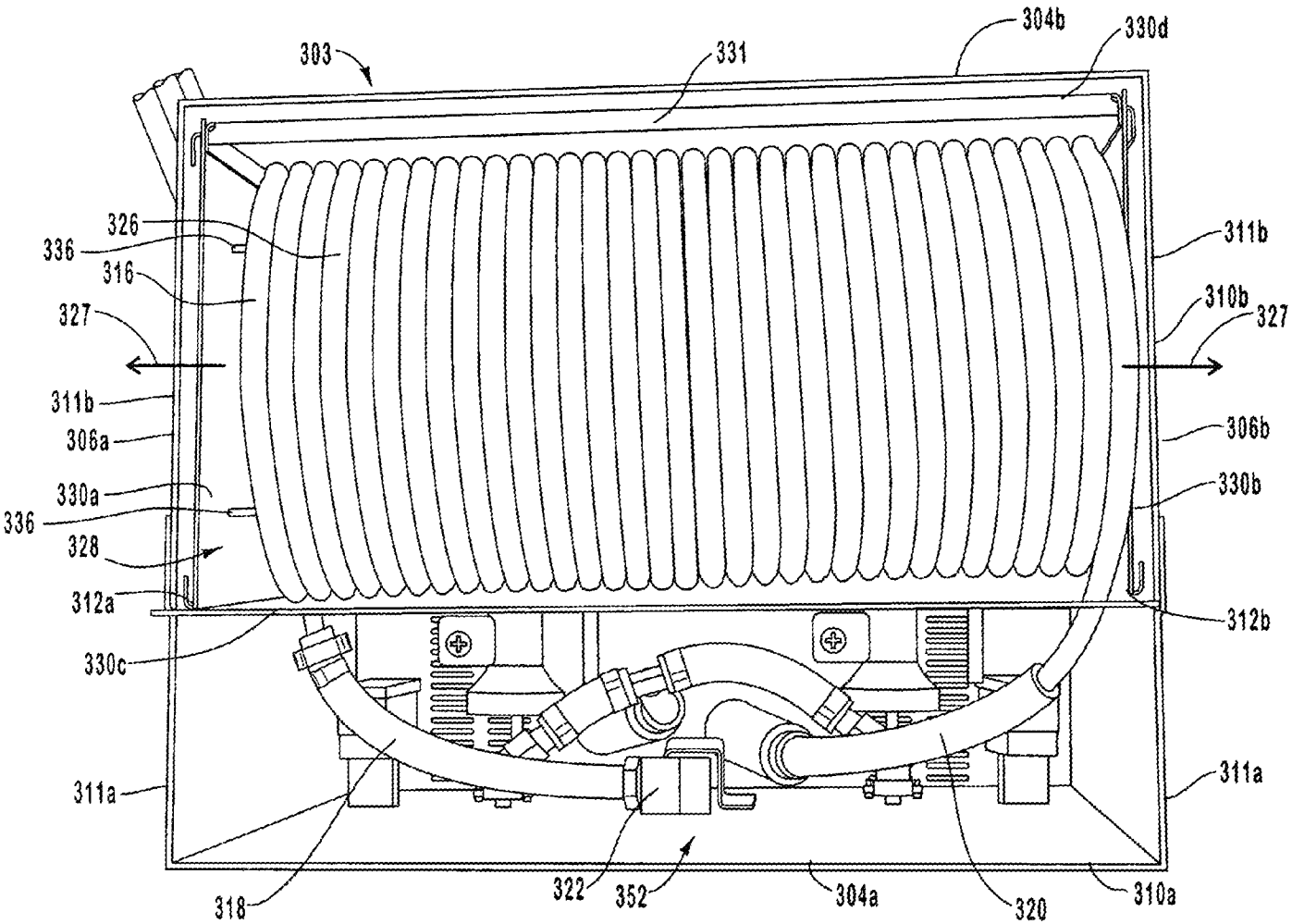
FIG. 13 is a top plan view of the heating assembly of FIG. 9, with the top cover removed.

With reference to FIGS. 12 and 13, a heat transfer conduit 316 is disposed within outer housing 303. An intake conduit 318 and an outlet conduit 320 can enter outer housing 303 to be placed in fluid communication with opposing ends of heat transfer conduit 316. Although not shown, intake conduit 318 can be connected to a pump or other fluid source. Similarly, outlet conduit 320 can terminate in an appropriate spray head as described above.

Appropriate inlets and/or outlets may be formed in outer housing 303 as required to allow intake conduit 318 and/or outlet conduit to 320 to enter outer housing 303. For example, as shown in FIG. 11, an aperture is formed in bottom cover 308*b* to allow intake conduit 318, outlet conduit 320 and a fuel conduit 324 (which will be described further below) to enter outer housing 303. However, intake conduit 318, outlet conduit 320 and/or fuel conduit 324 may be positioned at any suitable location of outer housing 303 depending on design configurations. Further, while the embodiment depicted in FIG. 11 shows intake conduit 318, outlet conduit 320 and fuel conduit 324 positioned together, it will be appreciated that the intake conduit, outlet conduit, and/or fuel conduit may be positioned together or be spaced apart without effecting the functions thereof.

As shown in FIGS. 12 and 13, in one embodiment, heat transfer conduit 316 is constructed of a coiled tube 326. That is, the coiled tube 326 includes a tubular conduit which is wrapped in a coil configuration. In one embodiment, the cross-section of the tubular conduit can be substantially circular. It will be appreciated that the cross-section of the tubular conduit may take on various configurations including, but not limited to, oval, round, square, parabolic, polygonal, and the like.

One end of intake conduit 318 is connected to a first end of coiled tube 326 and an end of outlet conduit 320 is connected to the second end of coiled tube 326. In one embodiment, coiled tube 326 has a substantially cylindrical cross-section. The cross-section of the coiled tube 326 can, but is not required to, have a constant diameter. For example, the cross-section of the coiled tube 326 can have a smaller diameter at one end than at the other, or the cross-section of the coiled tube could have a smaller diameter in the middle portion thereof than at the opposing ends thereof. It will be appreciated that, as discussed above, the cross-section of coiled tube 326 may have various configurations such as, but not limited to, oval, round, square, rectangular, or any combination thereof.

In the embodiment shown in FIGS. 12 and 13, coiled tube 326 can be disposed along a horizontal axis 327 instead of a vertical one as shown in previous embodiments. Yet, it is possible for the coiled tube 326 to be placed along a vertical axis. Further, heat transfer conduit 316 may vary in length or shape. In another embodiment, more than one heat transfer conduit 316 may be disposed in the outer housing 303. For example, a smaller coiled tube can be placed within a larger coiled tube, as discussed above.

As most clearly shown in FIG. 13, in another embodiment, heat transfer conduit 316 is positioned in and mounted in a chamber 328 formed in outer housing 303. Chamber 328 is at least partially formed by two side plates 330*a*, 330*b*, a front plate 330*c*, and a rear plate 330*d*. The chamber 328 provides locations to connect portions of heat transfer conduit 316 and/or burner assembly 340 (FIG. 15). Side plates 330*a* and 330*b* support heat transfer conduit 316 as described below. Plates 330 can also provide added structural support to outer housing 303.

In one embodiment, although not shown, heat transfer conduit 316 can extend substantially across the length of outer housing 303 and be mounted to outer housing 303, such as with welds, adhesives, friction fits, combinations thereof, or other manner for securely mounting the heat transfer conduit. The heat transfer conduit 316 absorbs heat emitted by burner assembly 340 (discussed further below) during combustion of the fuel and transferring the heat to fluid flowing through the heat transfer conduit 316. In one embodiment, the heat transfer conduit 316 is composed of copper, metals, or other conductive material. It will be appreciated that heat transfer conduit 316 could be composed of other materials that are capable of transferring heat.

Plates 330 also assist to retain the heat near heat transfer conduit 316 and can also serve to partially insulate the walls of outer housing 303. By retaining the heat generated by fuel burner assembly 340 (FIG. 15) toward heat transfer conduit 316, and insulating at least a portion of the heat produced by the fuel burner assembly from reaching the front wall 304*a*, rear wall 304*b*, and side walls 306*a*, 306*b*, plates 330 help reduce the amount of heat that reaches outer housing 303 so as to keep the surface of outer housing 303 cooler during operating of water heater 300. Plates 330 thereby increase the safety of the water heater 300 by reflecting the heat produced by the fuel burner assembly away from outer housing 303 so that outer housing 303 is not the primary point of heat contact. Plates 300 can be constructed of the same or different material as outer housing.

As shown in FIG. 13, side plates 330*a* and 330*b* can be connected to side walls 306*a*, 306*b* by, for example, outwardly curved portions formed at the ends of the side plates. In one embodiment, front plate 330*c* is disposed across the opening formed by legs 311*b* of rear portion 310*a*. The ends of front plate 330*c* are connected to optional lips 312*a*, 312*b* of rear portion 310*a*. It will be appreciated that front plate 330*c* could be attached to outer housing 303 in various other locations and manners. In the embodiment illustrated, rear plate 330*d* includes an upwardly bent rim 331. Opposing ends of rim 331 are connected to side plates 330*a*, 330*b*. It will be appreciated by one skilled in the art that various other configurations of rear plate 330*d* could be used. Further, rear plate 330*d* could be attached to side plates 330*a*, 330*b* in various other manners known in the art. Finally, when top cover 308*a* (FIG. 12) and bottom cover 308*b* (FIG. 14) are placed over top opening 305*a* and bottom opening 305*b*, respectively, chamber 328 is formed. Connection between the various components of chamber 328 can be made by welding, bolting, riveting, and the like.

As shown in FIG. 12, in one embodiment, the top region of front plate 330*c* extends past the edges of side walls 306*a*, 306*b*. During operation, the top cover 308*a* is placed over the top opening 305*a* as depicted in FIG. 10. Returning to FIG. 12, the top cover 308*a* includes a lip around the edge thereof, which can be configured to be disposed inside or outside of the top opening 305*a*. The lip of top cover 308*a* includes slots 358 positioned to receive portions of outer housing and/or plates 330. Thus, when the top cover 308*a* is disposed over the top opening 305*a*, slots 358 receive a portion of the top edge of front plate 330*c*, thus substantially sealing the top opening 305*a*. Because the top edge of front plate 330*c* extends past sidewall 306*a*, 306*b*, it abuts the surface of top cover 308*a* so that chamber 328 is substantially sealed from the rest of outer housing 303, at least in the top region. In addition, the surface of top cover 308*a* includes a plurality of apertures 360, which are in communication with chamber 328. It will be appreciated that top cover 308*a* may have various configurations so long as it performs the function of covering the top opening 305*a* and cooperates with outer housing 303. In addition, top cover 308*a* is not absolutely necessary for the adequate operation of water heater 300.

In one embodiment illustrated in FIG. 14, the bottom region of rear plate 330*d* includes optional channels 356 so that portions of burners (discussed below) of burner assembly 340 can extend therethrough and be connected to rear wall 304*b* (FIG. 13) of outer housing 303. Brackets 348 are provided for securely connecting the burners to rear wall 304*b*. Also shown in FIG. 14, bottom region of side plates 330*a*, 330*b* include notches 364 formed therein. When bottom cover 308*b* is placed over the bottom opening 305*b*, the notches 364 allow heat from chamber 328 to escape therethrough.

As shown in FIG. 11, the bottom cover 308*b* covers the bottom opening 305*b*. The bottom cover 308*b* includes a lip around the edge thereof, which can be configured to be disposed inside the bottom opening 305*b* or outside the bottom opening 305*b*. The surface of the bottom cover 308*b* includes a plurality of apertures 362 so that heat from chamber 328 can be released therefrom. It will be appreciated, however, that since the burners (discussed below) are facing away from the bottom opening 305*b*, less heat will be released from bottom cover 308*b* than from top cover 308*a*. It will also be appreciated that bottom cover 308*b* may have various configurations so long as it performs the function of covering bottom opening 305*b*. In addition, it will be appreciated that bottom cover 308*b* is not absolutely necessary for the suitable operation of water heater 300. Thus, as used herein, the term "housing" does not require that the walls of the housing form a complete enclosure.

As shown in FIG. 13, one or more support rods 336 extend between side plates 330*a*, 330*b*. The support rods 336 can be connected to side plates 330*a*, 330*b* through welding, riveting, bolting, and the like. It will also be appreciated that, alternatively, support rods 336 could be mounted to side walls 306*a* and 306*b* without affecting the function thereof. The coiled tube 326 of heat transfer conduit 316 is disposed about support rods 336 so that the weight of the coiled tube can be evenly distributed thereon.

Figure 16:
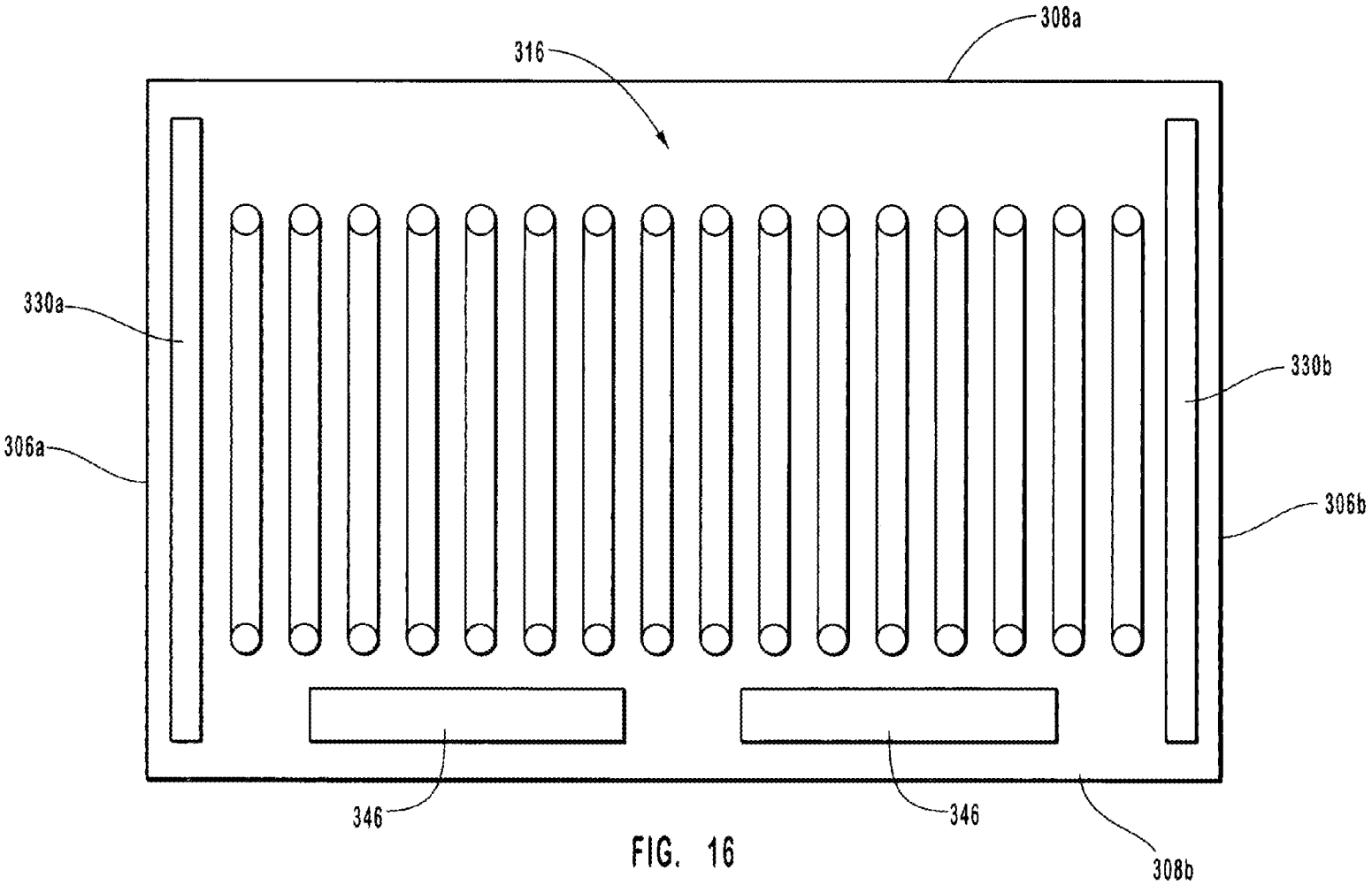
FIG. 16 is a schematic cross-sectional view of the heating assembly of FIG. 9.

Turning now to FIGS. 14 and 15, burner assembly 340 is disposed proximate to heat transfer conduit 316. As shown in FIG. 16, components of the burner assembly 340 are thus positioned below heat transfer conduit 316. As mentioned above and as will be described in more detail below, outer housing and plates 330 can provide structural support for portions of the fuel burner assembly 340. As depicted in FIGS. 14 and 15, fuel burner assembly 340 includes two or more burners 346 that are mounted in close proximity to and generally disposed from heat transfer conduit 316.

The burners 346 can be 35,000 BTU burners and fabricated from cast-iron or other material capable of withstanding the elevated temperatures. Although reference is made to 35,000 BTU burners, one skilled in the art will understand that burners 346 can be rated greater or lesser then 35,000 BTU. Additionally, although only two burners are shown, one can understand that water heater 300 can include a greater or lesser number of burners. Furthermore, while two burners 346 are shown in the embodiment of FIGS. 14 and 15, it will be appreciated that a user can control the burners so that one burner operates while the other is unoperational. In addition, the user can vary the amount of fuel that is directed to each burner 346 so that one burner may be operating at a higher temperature than the other.

With further reference to FIG. 15, to supply burners 346 with fuel from the fuel source (FIG. 9), fuel burner assembly 340 includes fuel conduit 324, one or more connectors 350, and one or more control valve assemblies 344. Fuel conduit 324 attaches to connectors 350 at one end and a conventional propane tank connector at the other end so that fuel burner assembly 340 cooperates with the fuel source, such as a conventional pressurized propane tank (FIG. 9). The connectors 350 can include any type of member that directs the flow of fuel from the fuel source, including but not limited to, tubular members, conduit, brackets, metal connectors, or the like. Valve assemblies 344 control the flow of fuel from the fuel source and controls the flow of fuel to burners 346. These valve assemblies 344 can include control knobs 344*a*, 344*b* attached thereto to enable a user to open and close valve assemblies 344.

Cooperating with burners 346 is an ignition device 342. In the exemplary configuration, ignition device 342 is an electric or piezo-electric spark igniter or automatic lighting devices. By manipulating ignition device 342, fuel flowing through fuel conduit 324, connectors 350, and valve assemblies 344 ignites to produce the desire heating of heat transfer conduit 316. It will be understood, that a user can manually ignite fuel exiting from burners 346.

As shown in FIG. 14, front plate 330*c* includes an inlet for allowing the intake conduit 318 to be connected to the heat transfer conduit 316. Similarly, front plate 330*c* has an outlet for providing a connection between the outlet conduit 320 and the heat transfer conduit 316. The bottom region of front plate 330*c* includes channels 354 so that a portion of burners 346 can be disposed outside chamber 328. It will be appreciated that various other configurations of openings can be formed in front plate 330 while still allowing the front plate to perform the functions thereof. Brackets 355 are provided for securely connecting the front of burners 346 to front plate 330*c*. In addition, apertures (not shown) are provided in front plate 330*c* for allowing portions of the ignition devices 342 to enter chamber 328. For example, a spark igniter connected to the ignition device 342 may be disposed in chamber 328 directly in front of burners 346 to provide a spark so that fuel from the burners can be ignited.

Returning to FIG. 10, a number of holes 338 in front wall 304*a* provide access to a user to portions of the valve assemblies 344 and ignition devices 342. For instance, one hole 338*a* can provide access to ignition device 342 (FIG. 15) of fuel burner assembly 340 so that a user can ignite the burners. Another hole 338*b* can receive valve assembly 344 (FIG. 15) of fuel burner assembly 340 so that a user can operate the valve assembly to allow fuel to flow from a fuel source (not shown). Further, another hole 338*c* can receive a temperature control valve assembly 352 (FIG. 13) so that a user can control the temperature of the heated water.

As shown more clearly in FIG. 13, the temperature control assembly 352 is disposed in communication with intake conduit 318. The temperature control assembly 352 allows a user to control the volumetric flow of fluid between the intake conduit 318 and the heat transfer conduit 316 so that more or less water flows through. As the flow of water is increased or decreased, the temperature of the water be corresponding decrease or increase. When the flow of water is increased, the water will have less residence time in the heat transfer conduit, thus cooling the water. Similarly, a decrease in the flow of water will result in the water having more time to heat in the heat transfer conduit, thus providing hotter water. As shown in FIG. 13, the temperature control assembly 352 may also serve the purpose of supporting the intake conduit 318 to outer housing 303. That is, a bracket 322 may be provided to hold a portion of intake conduit 318 against front wall 304*a* of outer housing 303 so that it is in proximity with the temperature control assembly 352.

The operation of water heater 300 is similar to that of water heater 10 described with respect to FIGS. 1-8. A fuel burner assembly is connected to a fuel source by way of various connectors. The valves of the fuel burner assembly prevent flow of fuel to the burners until they are opened through moving one or more control knows. Before moving the valves, the intake conduit and the outlet conduit are mounted to respective inlets and outlets of the heat transfer conduit. The free ends of the intake and outlet conduits are positioned in the desired positions, i.e., the free end of the intake conduit is placed in communication with a pump assembly or water reservoir and the free end of the outlet conduit is placed to provide a spray of water to a desired object (e.g., a human).

The fuel burners are ignited preferably when water is contained inside the heat transfer conduit to avoid steam formation. The user can open the valve assemblies and ignite the burner by turning the control knobs and manipulating the peizo-electric spark igniters of the ignition device. Lighting the fuel begins a sustained combustion at the surface of the burners and creates a large quantity of heat that is transmitted via radiation and convection in a generally upward direction. The heat is concentrated by the plates of the chamber toward the heat transfer conduit, which is arranged in one embodiment to maximize heat transfer from the combustion to the fluid contained therein. The heated water continuously flows through the heat transfer conduit, thereby providing a continuous stream of warm water.

After transmitting a significant portion of its heat to the heat transfer conduit, the remaining heat and exhaust gases produced by the burners continue to rise past the heat transfer conduit to the top of outer housing 303. This remaining heat and exhaust gases heat the top of outer housing 303, then safely exit into the atmosphere via openings formed therein. The heated top may be used as a heating surface for such things as food or water placed in a container (not shown) or for drying wet articles. The portable water heater can be used in adverse weather without the rain or snow penetrating the burner because of the configuration of outer housing 303.

As with the other water heaters described herein, generally, the heated water produced by the water heater can be directed to a structure, a vehicle, a human or animal body, or other location where heated water is desired.

FIGS. 17-21 illustrate additional embodiments of portable water heaters. These Figures will be generally simultaneously described indicating potential variations where convenient. The portable water heater 410 shown in FIG. 17 may include a heating assembly 450 that is configured to provide heated water to a user.

The heating assembly 450 may be supported by a base 471. The base 471 may include a plurality of base members 472. The base members 472 may be configured to support the heating assembly 450 above a work surface, such as the ground. The base members 472 may be operatively associated with the heating assembly 450.

In the present embodiment, the heating assembly 450 may be supported by three base members 472. In other embodiments, the heating assembly 450 may be supported by more or fewer base members 472. For example, two expanded base members (not shown) with an expanded base portion may be used. However, embodiments with three or more base members 472 may provide more stability than embodiments with fewer than three.

The base members 472 may have various cross sections. As shown in FIGS. 17-18 and 20-22, the base members 472 may have an "L"-shaped cross section. A generally concave cross section, such as an "L"-shaped cross section, a semi-circular cross section, or other cross section, may reduce an outer dimension, such as a diameter, of the portable water heater 410 in a stowed configuration, as shown in FIG. 21. In other embodiments, the base members 472 may have a convex, a generally planar, or other cross section.

The base members 472 may have a substantially uniform cross section along its length, as shown in FIGS. 17-22. In other embodiments, the cross section of one or more base members 472 may vary along the at least a portion of the length.

In the present embodiment, the base members 472 have approximately the same length as the heating assembly 450. The longer the base members 472 with respect to the heating assembly 450, the larger the footprint, and thus the larger the general stability, of the portable water heater 410. It may be desirable that the base members 472 and the heating assembly 450 have approximately the same length to provide a larger footprint while maintaining a reduced overall size in the stowed configuration.

Figure 18:
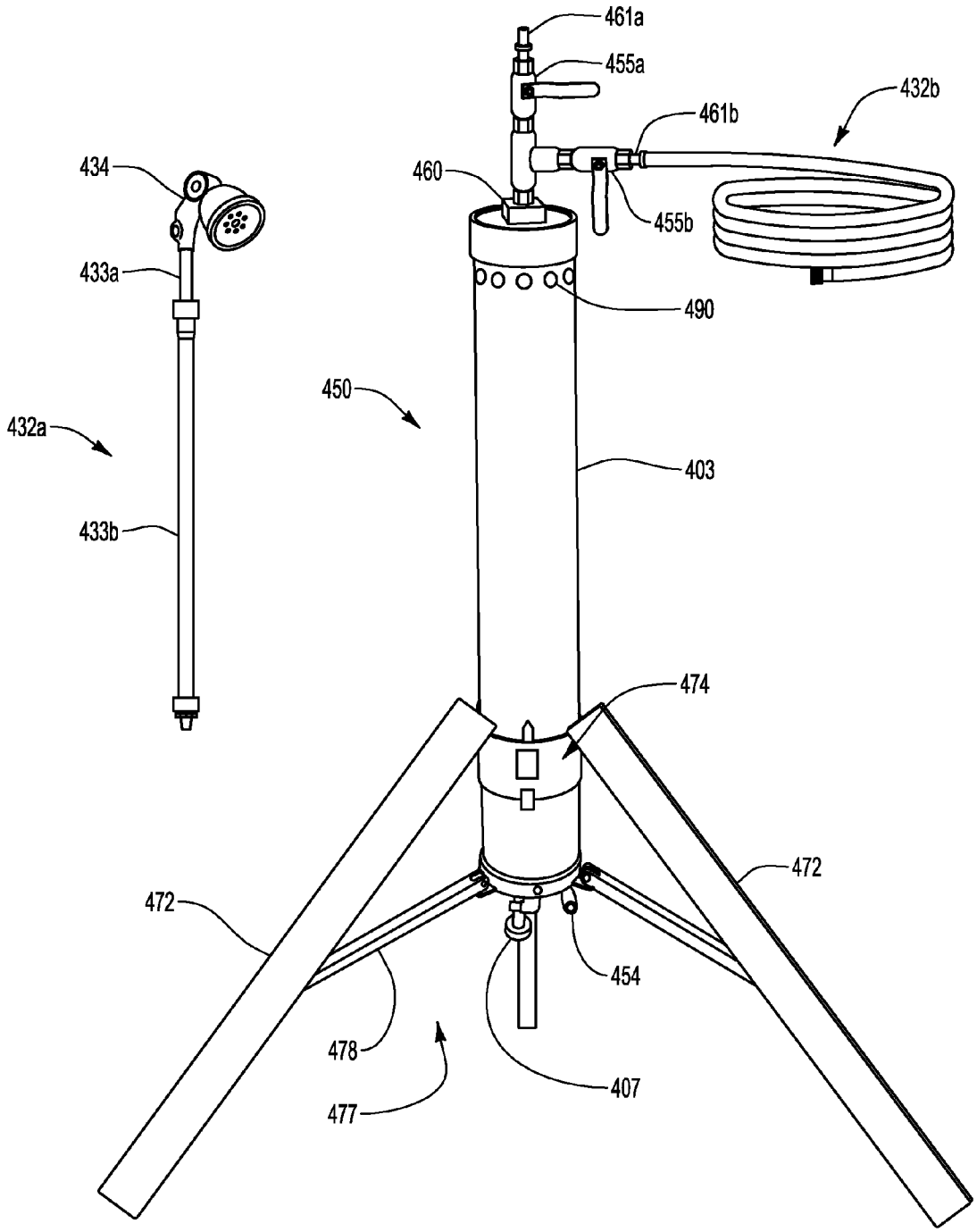
FIG. 18 is a partially exploded perspective view of the portable water heater shown in FIG. 17.

The base members 472 may transition from a stowed configuration toward a deployed configuration. The base members 472 are shown in FIG. 18 in a deployed configuration. In the deployed configuration, the base members 472 may facilitate stability of the base 471 for the heating assembly 450 by, for example, forming an expanded footprint.

FIG. 21 illustrates the base members 472 in a stowed configuration. In the stowed configuration, the base members 472 may have a reduced footprint. For example, in the stowed configuration, the portable water heater 410 may be capable of being stowed in a storage container, such as the storage bag 499 shown in FIG. 22. The storage bag 499 may be a rigid or non rigid storage bag to limit scratches and/or other damage to the heating assembly 450 in the stowed configuration. In other embodiments, storage bag 499 may alternatively be made of a variety of other non rigid materials including but not limited to, canvas, vinyl, mesh, or the like.

As shown in FIG. 18, the base members 472 may be pivotally and slidably associated with the heating assembly 450. In other embodiments, the base members 472 may be pivotally, slidably, otherwise associated, or combinations thereof.

The slidable association between the base members 472 and the heating assembly 450 may be facilitated with a slidable connector such as connecting mechanism 474. The connecting mechanism 474 may connect the base members 472 to the heating assembly 450 and/or may limit the motion of the base members 472 along the longitudinal axis. For example, the connecting mechanism 474 may be selectively operatively associated with the heating assembly 450. The operative association may be accomplished using a detent/recess system as shown in FIG. 18. Each of the base members 472 are shown connected to the connecting mechanism 474. In other embodiments, multiple connecting mechanisms 474 may be associated with each base member 472 to facilitate independent movement along the length of the heating assembly 450.

The pivotal association may be formed by, for example, a pivoting assembly 477. The pivoting assembly 477 may include a pivoting member 478. The pivoting member 478 may be connected to a bottom portion of the heating assembly 450, such as near the bottom of the housing assembly 452, and/or to an intermediate or other portion of a corresponding base member 472. The pivoting member 478 may be connected with a pin type joint, a ball joint, other connections, or combinations thereof. In embodiments where the base members 472 have a concave cross section, the pivoting members 478 may be sized and/or configured to be stowed within the concave portion of the corresponding base member 472.

In the present embodiment, each base member 472 is shown connected to the connecting mechanism 474 and a corresponding pivoting member 478. In other embodiments, less than all of the base members 472 may be connected to one or more connecting mechanisms 474 and/or a corresponding pivoting member 478.

Figure 19:
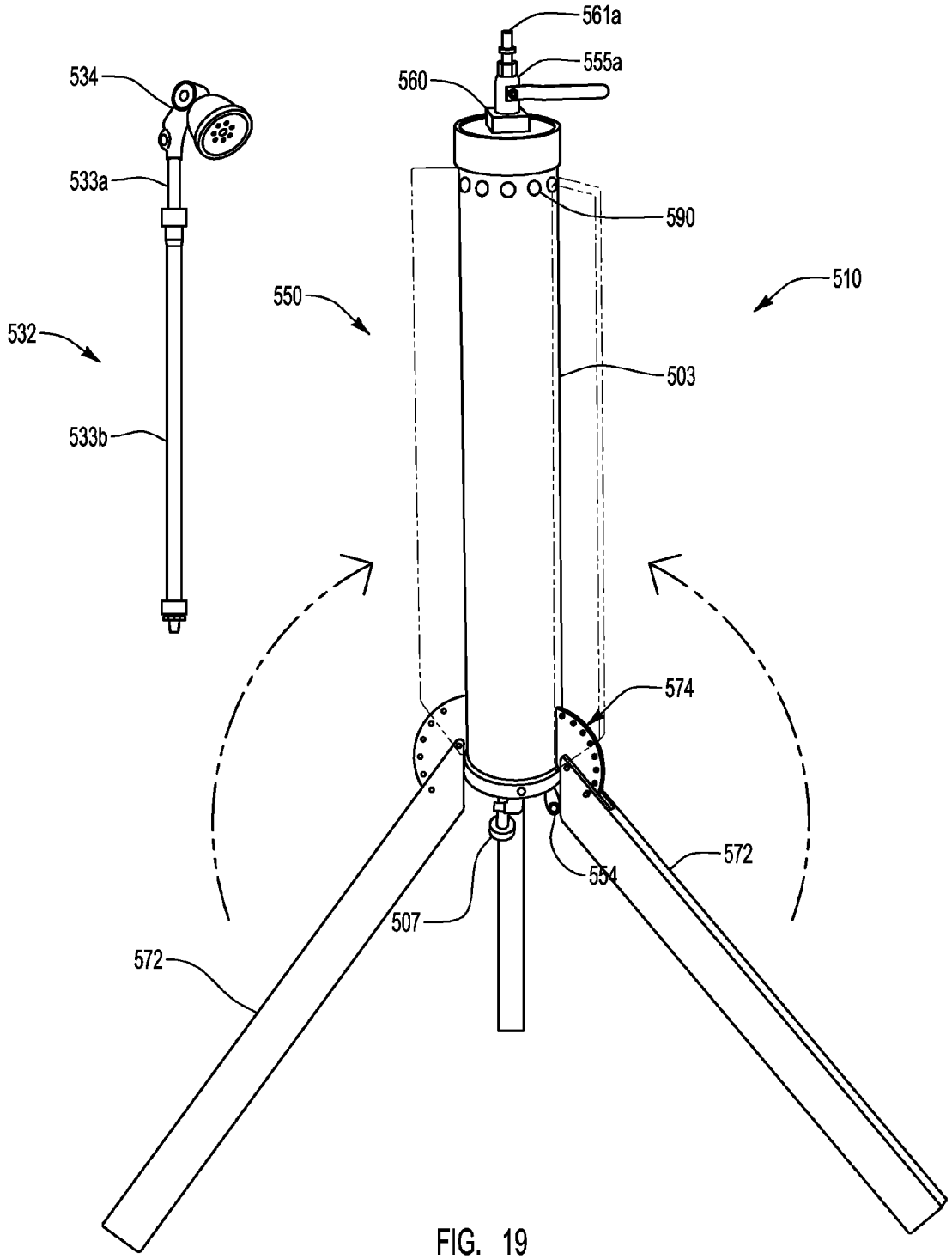
FIG. 19 is a partially exploded perspective view of another embodiment of a portable water.

For example, the base members 472 may be pivotally associated with, but not slidably connected to a bottom portion of the heating assembly 450. FIG. 19 illustrates a further embodiment of a base 570 of a portable water heater 510. The portable water heater 510 of this further embodiment may be functionally similar to the portable water heater 410 described herein in most respects, wherein certain features will not be described in relation to this embodiment wherein those components may function in the manner as described above and are hereby incorporated into this alternative embodiment described below. Like structures and/or components may be given like reference numerals.

As shown in FIG. 19, the base members 572 may pivot about pivoting assembly 577 from near the top of the heating assembly 550 toward the ground below the bottom of the heating assembly 550 into the deployed configuration. The motion of the base members 572 toward the top of the heating assembly 550 in the deployed configuration may be limited by a connecting mechanism 574. The connecting mechanism 574 shown in FIG. 19 may include a detent/recess system. For example, as a base member 572 is moved toward the deployed configuration from the stowed configuration a detent 575 may engage a corresponding recess 576 that limits the motion of the base member 572 toward the stowed configuration. Other connecting mechanisms 574 such as a ratcheting system, other connecting mechanisms, or combinations thereof may be used.

Returning to the embodiment shown in FIG. 18, the base members 472 may be pivotally associated to at least one connecting mechanism 474 that is slidably associated with the heating assembly 450. Thus, the base members 472 may transition into the deployed configuration by sliding from a top portion of the heating assembly 450 toward a bottom portion of the heating assembly 450 and by pivoting the bottom portions of the base members 472 outward from the longitudinal axis of the heating assembly 450. The motion of the base members 472 toward the top of the heating assembly 450 may be limited by a connecting mechanism, such as a ratcheting system, a detent/recess system, other connecting mechanisms, or combinations thereof, on the connecting mechanism.

The heating assembly 450 may provide thermal energy to a fluid passing through the heating assembly 450. Although the heating assembly 450 may generally heat water, other fluids may be similarly heated by the heating assembly 450. The heating assembly 450 may be sized and/or configured to provide about 40,000 BTU to the fluid passing through the heating assembly.

Figure 20:
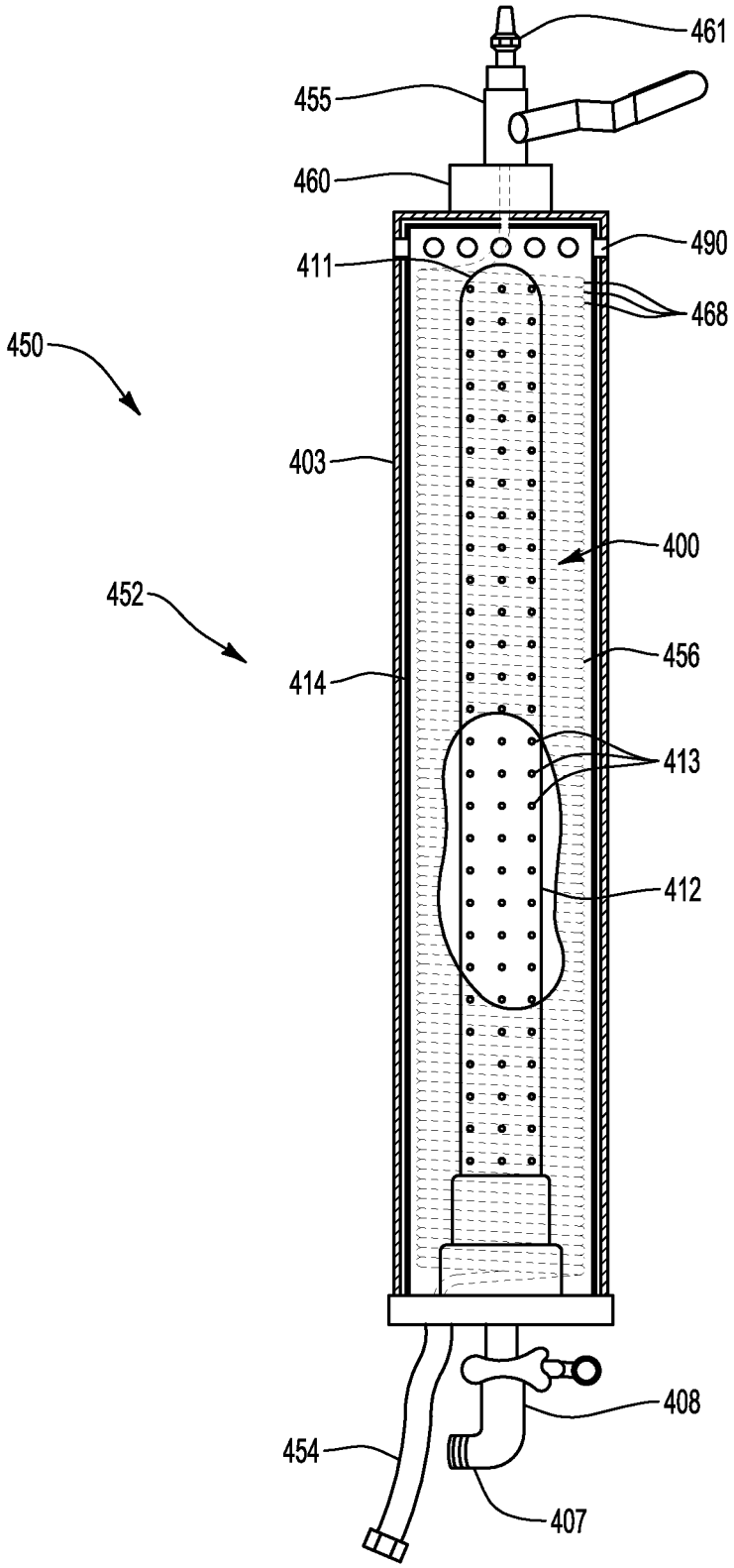
FIG. 20 is a partial cross sectional side view of a portion of the portable water heater shown in FIG. 17.
Figure 21:
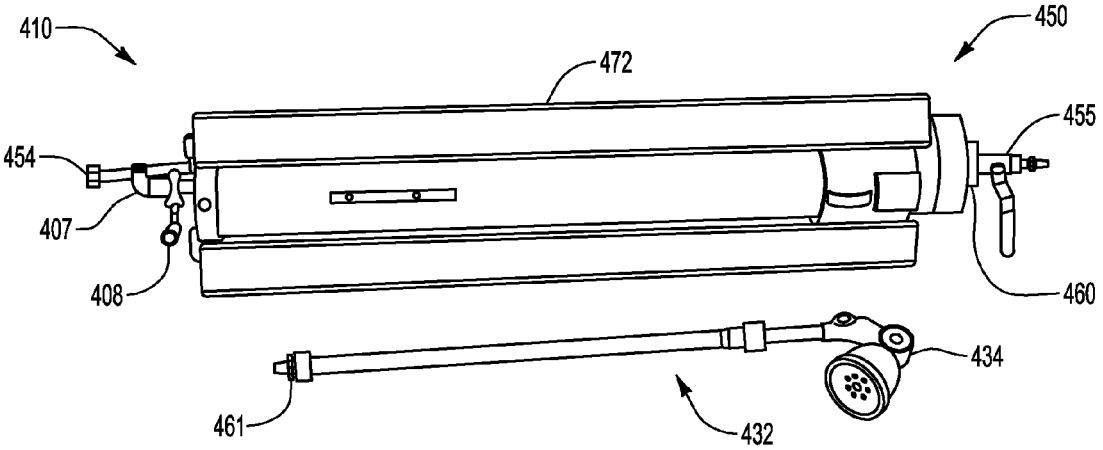
FIG. 21 is a partially exploded perspective view of the portable water heater shown in FIG. 17 shown in a collapsed configuration.
Figure 22:
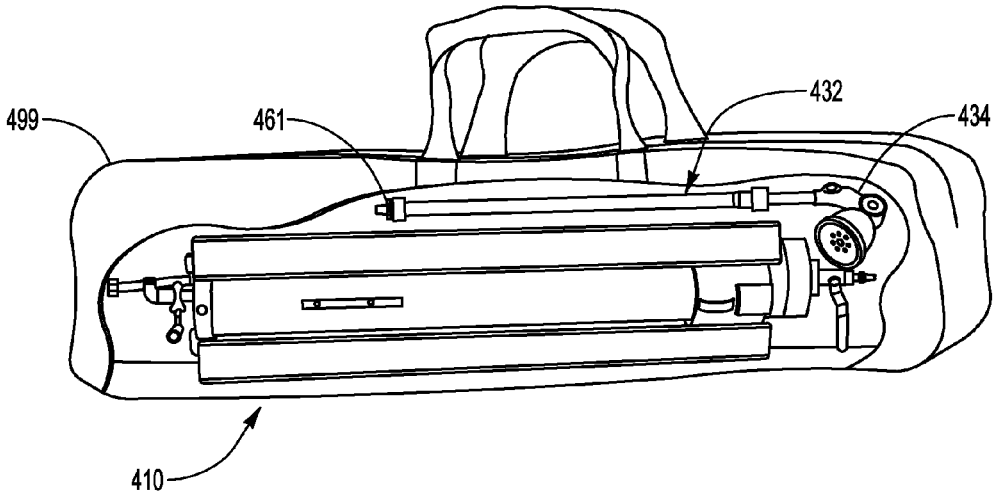
FIG. 22 is a partially exploded perspective view of the portable water heater shown in FIG. 17 shown stowed in a collapsed configuration.

The heating assembly 450, shown in FIG. 20, may include a generally elongate housing assembly 452. As described herein, the housing assembly 452 and at least one base member 472 may be approximately the same length. The housing assembly 452 may include a heat shield 414 and/or an outer housing 403.

The outer housing 403, in the present embodiment, may be elongate and/or cylindrical. In other embodiments, the outer housing 403 may be otherwise shaped. The outer housing 403 may be formed from metal, a high temperature plastic, other materials, or combinations thereof. The heat shield 414 may limit the amount of thermal energy transmitted through the outer housing 403.

The housing assembly 452 may house a thermal transfer conduit, such as heat transfer conduit 456. The heat transfer conduit 456 may incorporate at least one element of the heat transfer conduits described herein. As shown in FIG. 20, the heat transfer conduit 456 may include a plurality of coils 468. The coils 468 may be closely and/or loosely spaced.

In embodiments where the coils 468 are closely spaced, the heat shield may be omitted as the heat transfer conduit 456 may absorb sufficient thermal energy to limit the amount of energy transferred to the outer housing 403.

The heat transfer conduit 456 may have a substantially uniform diameter with respect to the longitudinal axis of the heating assembly 450. A maximum diameter of the heat transfer conduit 456 may be smaller than a minimum diameter of the outer housing 403 and/or heat shield 414.

The heating assembly 450 may be connected to a fluid source 411. For example, the thermal transfer conduit, such as heat transfer conduit 456, may be connected to a fluid source 411 through a fluid inlet 454. Although FIG. 17 illustrates the use of a culinary water source or other pressurized fluid source, a pump, such as pump 20 and power source 30 described herein, may be used in place of or in conjunction with a fluid source 411. For example, a pump, such as pump 20, may be powered by a twelve volt battery (not shown), such as a vehicle battery, that may provide sufficient power to pump up to, for instance, about two, about three, about six, or more than six gallons of water per minute.

The fluid source 411 may be in fluid communication with the portable water heater 410 through the fluid inlet 454. The fluid inlet 454 may be in fluid communication with a fluid outlet 460. For example, the fluid to be heated may enter the fluid inlet 454 passing through the heat transfer conduit 456 and exiting the fluid outlet 460.

The fluid inlet 454 and fluid outlet 460 are shown in FIG. 20 disposed on the bottom and top of the portable water heater 410, respectively. However, the fluid inlet 454 and/or fluid outlet 460 may be disposed in any suitable location with respect to the portable water heater 410. In the present embodiment, the fluid inlet 454 and fluid outlet 460 may be longitudinally and/or radially offset. In some embodiments, the fluid inlet 454 and fluid outlet 460 may be longitudinally aligned. For example, the fluid inlet 454 and fluid outlet 460 may be aligned with a longitudinal axis of the portable water heater 410.

The fluid flow through the heat transfer conduit 456 may be regulated by a fluid control valve 455. As shown in FIG. 20, the fluid control valve 455 may be disposed downstream from the fluid outlet 460. In other embodiments, the fluid control valve 455 may be disposed in any acceptable location between the fluid source 411 and a user.

The fluid outlet 460 may be in fluid communication with at least one outlet member. As shown in FIG. 18, the fluid outlet 460 may be in fluid communication with a first outlet member 432*a* and a second outlet member 432*b*.

The first and/or second outlet members 432*a*, 432*b* may be removable. For example, the outlet members 432*a*, 432*b* may be in fluid communication with the fluid outlet 460 by a connector 461*a*, 461*b* such as a threaded, quick release, or other connection. The connector 461 may limit fluid leaks while allowing for rotation about the connector 461. For example, as shown in FIG. 18, the first outlet member 432*a* may rotate about its longitudinal axis.

In embodiments with a first and second outlet member 432*a*, 432*b*, it may be desirable to include a first and second fluid control valve 455*a*, 455*b* to regulate fluid flow to the first and second outlet members 432*a*, 432*b*. In further embodiments, more outlet members and/or control valves may be included as desired. As described herein, regulation of fluid flow may also regulate the temperature of the fluid exiting the portable water heater 410.

Returning to FIG. 17, the portable water heater 410 is shown including only one outlet member 432. In other embodiments, such as the embodiment shown in FIG. 18, the portable water heater 410 is shown including only a plurality of outlet members (such as first and second outlet members 432*a*, 432*b*). The outlet member 432 (or any outlet member, such as first and second outlet members 432*a*, 432*b*) may include one or more extension members. As shown in FIG. 17, the outlet member 432 may include two extension members 433*a*, 433*b*. The extension members 433*a*, 433*b* may be extendable along the longitudinal axis of the outlet member 432.

The plurality of extension members 433*a*, 433*b* may be telescopically associated. For example, the extension members 433*a*, 433*b* may include a seal and/or other mechanism for facilitating longitudinal movement relative to each extension member 433*a*, 433*b* while maintaining a generally fluid tight seal. The first extension member 433*a* may be configured to receive the second extension member 433*b* and/or vice versa.

The extension members 433*a*, 433*b* may be configured to extend from a pre-extended length to an extended length. For example, the extension members 433*a*, 433*b* may extend from about two feet to about four feet. The lengths of the base members 472, the heating assembly 450, the extension members 433*a*, 433*b*, or combinations thereof may be determined to achieve an adequate height for a user to, for example, shower. For instance, the overall deployed extended height of the portable water heater 410 may be about seven feet.

A fluid directing element 434, such as a shower head, may be in fluid communication with the fluid outlet 460. As shown in FIG. 18, the fluid directing element 434 may be operatively associated with the second extension member 433*b*. In other embodiments, the fluid directing element 434 may be operatively associated with another extension member.

Returning to the embodiment shown in FIG. 18, the second outlet member 432*b* may include a fluid conduit, such as a garden hose, at least one extension element, a spigot, a faucet, other fluid conduits, or combinations thereof. The second outlet member 432*b* may be used, for example, for washing vehicles, dishes, etc.

Returning to FIG. 20, the heat transfer conduit 456 may receive thermal energy from at least one thermal source 400. The thermal source 400, in the present embodiment, may include at least one burner 412 that may include at least one element of the burners and/or other thermal sources described herein. The thermal source 400 may be sized to produce about 40,000 BTU of thermal energy. In other embodiments, the thermal source 400 may be sized to produce more or less than about 40,000 BTU of thermal energy.

As shown in FIG. 20, the thermal source 400 may be disposed within at least a portion of the heating assembly 450. In the present embodiment, the thermal source 400 may have a longitudinal length that is more and/or less than the longitudinal length of the heat transfer conduit 456.

The thermal source 400 may include a plurality of apertures 413. In the present embodiment, the thermal source 400 may include about sixty four apertures 413 that are longitudinally aligned and radially offset. In other embodiments, the thermal source 400 may include more or fewer apertures 413 that may be longitudinally aligned and/or radially offset.

A cap member 411 may be provided for the uppermost portion of the thermal source 400 that may facilitate the axial direction of thermal energy. The thermal source 400 may be in fluid communication with a fuel inlet 407. The fuel inlet 407 may be disposed near a bottom portion of the heating assembly 450. The fuel inlet 407 may receive fuel from a fuel source 402 from a local fuel storage tank, such as, for example, a propane tank, a remote fuel storage tank, such as, for example, through a natural gas line, other fuel sources, or combinations thereof.

The thermal source 400 may produce thermal energy by igniting fuel as described herein. For example, an electronic ignition powered by, for example, a AA battery, and/or a manual ignition may ignite a propane fuel source. The ignition (not shown) may be located near the bottom portion of the heating assembly 450. For example, the ignition may be disposed on the bottom or side of the heating assembly 450.

The amount of fuel provided to the thermal source 400 may be controlled by a fuel valve 408. The temperature of the fluid exiting the portable water heater 410 may be directly controlled by the fuel valve 408, the fluid control valve 455, other control mechanisms, or combinations thereof. Furthermore, the portable water heater 410 may be designed to provide a desired flow rate, temperature, and other characteristics by varying the size, shape, or other features of the heat transfer conduit 456, thermal source 400, other elements of the portable water heater 410, or respective combinations thereof.

The heat shield 414 and/or coil spacing of the heat transfer conduit 456 described herein may limit the amount of thermal energy that passes through the outer housing 403. In addition, a plurality of apertures 490 may be disposed on the heating assembly 450 to direct the generated thermal energy and/or exhaust out of the heating assembly 450.

Although the present disclosure has been described in terms of certain preferred embodiments, other embodiments apparent to those skilled in the art are also within the scope of the disclosure. Thus, the described preferred embodiments are to be considered in all respects only as illustrative and not restrictive. Accordingly, the scope of the disclosure is intended to be defined only by the following claims. All changes that come within the meaning and range of equivalency of the claims are to be embraced within their scope.

What is claimed is:

1. A portable water heater comprising:

an elongate housing having a first end and a second end;

a base mounted to said housing, said base comprising a plurality of elongate base members pivotably mounted to said base;

at least one elongate thermal source disposed substantially entirely within said housing, said at least one elongate thermal source extending longitudinally within the housing for the majority of the length of the housing, the at least one thermal source being configured to produce thermal energy in the housing;

a thermal transfer conduit disposed within said housing, the thermal transfer conduit further being disposed circumferentially around the at least one elongate thermal source; and a heat shield disposed proximate an inner surface of the elongate housing from the first end to the second end of the housing and circumferentially about the thermal transfer conduit and the at least one elongate thermal source.

2. The portable water heater of claim 1, wherein said base further comprises a connecting mechanism movably mounted to at least a portion of said housing, at least one of said plurality of base members being operatively associated with said connecting mechanism.

3. The portable water heater of claim 1, wherein a portion of said base is collapsible against an exterior surface of said housing.

4. The portable water heater of claim 2, wherein at least one of said plurality of base members is operatively associated with said housing by a pivoting member.

5. The portable water heater of claim 3, wherein a pivoting member is configured to be substantially enclosed by a corresponding base member of said plurality of elongate base members in a collapsed configuration.

6. The portable water heater of claim 3, wherein a pivoting member is operatively associated with an intermediate portion of a corresponding base member of said plurality of elongate base members.

7. The portable water heater of claim 1, wherein at least one of said plurality of base members has a substantially concave cross-section.

8. The portable water heater of claim 1, wherein said base is at least partially slidably mounted to said housing.

9. A portable water heater comprising:

an elongate housing having a first end and a second end;

a base at least partially movably mounted to said housing, a portion of said base being collapsible;

at least one elongate thermal source disposed substantially entirely within said housing, said elongate thermal source extending longitudinally within the housing from the first end to proximate to the second end, the at least one thermal source being configured to produce thermal energy in said housing; and a thermal transfer conduit disposed within said housing, the thermal transfer conduit disposed circumferentially about the length of the at least one elongate thermal source such that substantially all of the thermal energy is directed at the thermal transfer conduit.

10. The portable water heater of claim 9, wherein said thermal transfer conduit substantially surrounds said at least one elongate thermal source.

11. The portable water heater of claim 10, wherein said thermal transfer conduit further comprises a substantially vertically coiled tubular portion.

12. The portable water heater of claim 9, further comprising a thermal shield between an interior surface of said housing and an exterior surface of said thermal transfer conduit, the thermal shield extending from the first end to the second end of the housing.

13. The portable water heater of claim 9, wherein said base further comprises a plurality of base members.

14. A portable water heater comprising:

an elongate housing having a first end and a second end;

a base at least partially removably mounted to said housing, a portion of said base being pivotable;

at least one elongate thermal source disposed substantially entirely within said housing, the at least one elongate thermal source extending longitudinally within the housing from the first end to proximate to the second end, said elongate thermal source having a longitudinal axis and being configured to produce thermal energy in said housing and direct said thermal energy substantially perpendicularly to said longitudinal axis of the at least one elongate thermal source; and a thermal transfer conduit disposed within said housing, the thermal transfer conduit disposed circumferentially about the at least one elongate thermal source such that substantially all of the thermal energy is directly transmitted by the at least one thermal source to the thermal transfer conduit along substantially the entire the length thereof.

15. The portable water heater of claim 14, further comprising an outlet member in fluid communication with said thermal transfer conduit.

16. The portable water heater of claim 15, wherein said outlet member further comprises two extension members that are telescopically associated and are extendible in length with respect to said housing.

17. The portable water heater of claim 15, wherein said outlet member is rotatable about a longitudinal axis of said housing.

18. The portable water heater of claim 14, further comprising a second outlet member in fluid communication with said thermal transfer conduit.

19. The portable water heater of claim 18, wherein said second outlet member further comprises a garden hose.

20. The portable water heater of claim 13, further comprising a rigid storage container configured to store the portable water heater in a disassembled state.

* * * * *